US005445913A

United States Patent [19]

Bailey et al.

[11] Patent Number: 5,445,913

[45] Date of Patent: Aug. 29, 1995

[54] PROCESS FOR THE FORMATION OF HEAT IMAGE SEPARATION ELEMENTS OF IMPROVED SENSITOMETRY

[75] Inventors: David S. Bailey, Rochester; Richard L. Parton, Webster, both of N.Y.

[73] Assignee: Eastman Kodak Company, Rochester, N.Y.

[21] Appl. No.: 202,309

[22] Filed: Feb. 25, 1994

[51] Int. Cl.[6] ..... G03C 8/40; G03C 8/10; G03C 1/015

[52] U.S. Cl. ..... 403/203; 430/217; 430/546; 430/559; 430/570; 430/617; 430/935

[58] Field of Search ..... 430/203, 617, 935, 570, 430/559, 546, 217

[56] References Cited

U.S. PATENT DOCUMENTS

| | | | |
|---|---|---|---|
| 2,912,343 | 11/1959 | Collins et al. | 430/570 |
| 4,124,397 | 8/1980 | Fuchigami et al. | 430/935 |
| 4,218,533 | 8/1980 | Fuchigami et al. | 430/935 |
| 4,289,847 | 9/1981 | Ishikawa; et al. | 430/389 |
| 4,455,366 | 6/1984 | Hirano et al. | 430/381 |
| 4,607,004 | 8/1986 | Ikenoue et al. | 430/253 |
| 4,804,616 | 2/1989 | Ueda et al. | 430/379 |
| 5,028,523 | 7/1991 | Skoug | 430/617 |
| 5,064,742 | 11/1991 | Aono et al. | 430/203 |
| 5,064,753 | 11/1991 | Sobel et al. | 430/617 |
| 5,077,190 | 12/1991 | Steiger | 430/570 |
| 5,079,137 | 1/1992 | Taguchi et al. | 430/203 |
| 5,112,733 | 5/1992 | Ihama | 430/569 |
| 5,137,803 | 8/1992 | Goda | 430/569 |
| 5,166,045 | 11/1992 | Wu | 430/569 |
| 5,168,035 | 12/1992 | Lushington et al. | 430/569 |
| 5,270,145 | 12/1993 | Willis et al. | 430/203 |
| 5,360,695 | 11/1994 | Texter | 430/203 |
| 5,370,966 | 12/1994 | Bagchi et al. | 430/203 |

FOREIGN PATENT DOCUMENTS

| | | |
|---|---|---|
| 2111176 | 6/1972 | France . |
| 2277360 | 7/1975 | France . |
| 3406600A1 | 8/1984 | Germany . |
| 62-136645 | 6/1987 | Japan . |
| 3-184038 | 8/1991 | Japan . |
| WO 89/06829 | 7/1989 | WIPO . |

*Primary Examiner*—Richard L. Schilling
*Attorney, Agent, or Firm*—Paul A. Leipold

[57] ABSTRACT

The invention is directed to a process for forming a chromogenic photographic heat-transferable non-aqueous dye-diffusion-transfer photographic element comprising the steps of: providing, separately, a melt comprising a spectrally dye-sensitized silver halide emulsion and a dry diffusion transfer facilitating thermal solvent; mixing said spectrally dye sensitized silver halide emulsion melt and said dry diffusion transfer facilitating thermal solvent with a mixing means to create a mixed melt; providing a coating substrate; coating said mixed melt on said substrate to form a coated photographic element, wherein said coating takes place less than about 10 minutes after mixing.

The heat-transferable photographic element thus formed has improved photographic sensitivity and increased sensitometric uniformity.

44 Claims, 1 Drawing Sheet

PROCESS FOR THE FORMATION OF HEAT IMAGE SEPARATION ELEMENTS OF IMPROVED SENSITOMETRY

FIELD OF THE INVENTION

This invention relates to a method of forming chromogenic photographic imaging elements that utilize silver halide based radiation-sensitive layers and materials that form image dyes which in a subsequent thermally activated process are transferred to a polymeric receiver layer after which the layers are separated to obtain an image dye layer and silver containing image originating layer. In particular, this invention relates to the method of manufacturing of such photographic systems wherein a dye-diffusion-transfer facilitating material is contained in a layer with a dye sensitized silver halide emulsion.

BACKGROUND OF THE INVENTION

A novel method of forming chromogenic photographic images, wherein conventional development processes comprising both aqueous development and dry thermal development are utilized in combination with substantially dry thermally activated transfer of the resulting dye images to a polymeric receiver layer has been described by Willis and Texter in U.S. Pat. No. 5,270,145. A substantial improvement in the imaging system, as disclosed by Bailey, Texter and White, U.S. patent application Ser. No. 08/804,868 filed Dec. 6, 1991; Bailey, Texter and White, U.S. patent application Ser. No. 08/073,821 filed Jun. 8, 1993; Bailey and Mura, U.S. patent application Ser. No. 08/073,825 filed Jun. 8, 1993; Bailey and Mura, U.S. patent application Ser. No. 08/073,822 filed Jun. 8, 1993; Bailey, Mura and Eiff, U.S. patent application Ser. No. 08/073,826 filed Jun. 8, 1993 and Bagchi and Bailey, U.S. patent application Ser. No. 08/159,022 filed Nov. 29, 1993, is obtained by the addition of certain materials to one or more of the layers that constitute the imaging element.

The essential morphology of such an imaging system is illustrated in FIG. 1. This imaging element consists of, for example, a conventional chromogenic photographic multilayer imaging element coated on a polymeric receiver element. The conventional imaging element (hereafter image originating element or donor layer) consists of one or more imaging layers, optionally one or more interlayers and one or more protective layers (layers 1,2, . . . , N in FIG. 1) Any or all of these layers may contain the dye-diffusion transfer facilitating materials described in the aforementioned patents and applications, but in particular these materials may be incorporated in the silver halide imaging layer. The polymeric receiver layer consists of one or more layers of the same or different materials. The receiving layer is coated on the appropriate transparent or reflective base. The image originating element is coated on the polymeric receiver element with an optional intervening stripping layer. The images are created by conventional radiation sensitivities in the silver halide emulsion containing layers, and these images are amplified using development processes well known in the art. After development, the development is stopped by appropriate means, and the element is dried. No fixing or bleaching chemistry is invoked in this process. After the elements have been dried, they are subject to heating in order to transfer the image dyes to the receiver layer. After such an image transfer process, the donor layers are separated from the dye receiver layer. The receiver layer and supporting base is retained as the final image element. The donor layer, containing the silver, silver halide and fine organic chemicals associated with the imaging process is available for recycling. These inventions thus reduce the amount of waste material generated in the photographic development process by not employing any bleach, fix or bleach-fix (blix) chemistry and makes available the conventionally retained organic chemicals for efficient recycling.

Dye sensitized silver halide emulsions can be subject to substantial unsensitization, the desorption of spectral sensitizing dyes from silver halide, which results in a loss in photographic sensitivity in the presence of certain materials that are incorporated in an imaging layer of chromogenic imaging elements. Substantial efforts can be expended in materials modifications or process optimizations in order to solve the problem of unsensitization in dye sensitized silver halide imaging elements.

It is well known in the art that melts containing dye-sensitized silver halide emulsions and coupler dispersions that show melt-hold unsensitization can be successfully coated with improved sensitometric characteristics by mixing individual melts of the dye sensitized silver halide emulsion and the coupler dispersion at some shorter time prior to coating. Continuous processes that mix the incompatible melts at a common junction prior to delivery to the coating hopper, known as dual-melt coatings, are well known.

Collins and Wellford, in U.S. Pat. No. 2,912,343 issued Nov. 10, 1959 disclosed the method of producing color photographic elements comprising a dye sensitized silver halide emulsion and the color coupler or other components that tend to reduce the sensitivity of the emulsion over time by controlling the time between mixing and coating. In particular Collins and Wellford disclose the use of an in-line active mixing means to continuously coat a red dye sensitized photographic element containing the cyan coupler, 1-hydroxy-2-naphthoyl-stearylamine-4-sulfonic acid sodium salt.

In-line mixing of liquids is well known in many chemical technologies as is described in various sources including a chapter on mixing and blending by Oldshue and Todd in the "Kirk-Othmer Encyclopedia of Chemical Technology", 3rd Ed., vol. 15 Wiley-Interscience, New York, 1981 and references cited therein.

An alternate means of controlling the solution contact time between incompatible materials is achieved by intimate mixing of solid particles followed by continuous or on-demand liquefaction of the solid mixture prior to coating.

Apparatus to continuously liquefy the photographic melts are disclosed in French Patent 2,111,176 assigned to Agfa-Gevaert, filed May 8, 1972 and French Patent 2,277,360 assigned to Agfa-Gevaert, filed Jul. 4, 1975 and by Ichikawa et al. in German Patent 3406600, filed Feb. 23, 1983 and by Eaton, Toner and Wooster in U.S. Pat. No. 5,191,910. Kresinske, Winkler and Possanza, U.S. patent application Ser. No. 08/163,245 filed Dec. 6, 1993, discloses an apparatus and method for on-demand liquefaction of solid chunks of aqueous gelatin melts.

Le Faou and Hervieux, International Patent Application WO 89/06829 filed Jan. 18, 1989, disclosed a process for obtaining silver halide photographic compositions from individually prepared melts that are chill chunked and cold mixed then liquefied just prior to introduction to the coating station.

All of these aforementioned methods achieve some control over the solution contact time between the dye-sensitized silver halide emulsion and the potentially sensitometrically deleterious material in another melt.

The methods and materials for chemical sensitization of silver halide emulsions are well established in the art of photography. Numerous reviews and summaries of the techniques and materials and the photographic consequences of chemical sensitization have been published including "The Theory of the Photographic Process, 4th Ed.", Chapter 5, edited by T. H. James and published by Macmillan Publishing Co, New York (1977). A particular example of chemical sensitization disclosed, for example, by Davey and Knott in U.S. Pat. No. 2.592,250 (Apr. 8, 1952) is termed halide conversion. This consists of treating the completed emulsion with an alkali halide solution capable of forming a less soluble silver salt than the original silver halide emulsion. In the case of silver chloride emulsions subsequently treated with a doctor solution of alkali bromide as described, for example, by Deaton in U.S. Pat. No. 5,049,485 there is advantageously obtained improvements in stability to development fog and in spectral sensitizing dye adsorption as disclosed in *Research Disclosure,* Issue 176, Item No. 18716 (November, 1979).

PROBLEM TO BE SOLVED BY THE INVENTION

We have found that the incorporation of the dry dye-diffusion-transfer facilitating materials in a spectrally dye-sensitized silver halide emulsion containing layer has deleterious effects on the photographic sensitivity of these emulsions. Under some conditions losses in photographic sensitivity can approach six stops (64-fold) or an log exposure index of 1.8. Such an enormous variability is catastrophic for a photographic product.

This and other problems may be overcome by the practice of our invention.

SUMMARY OF THE INVENTION

An object of the present invention is to provide chromogenic photographic heat-transferable non-aqueous dye-diffusion-transfer photographic elements of improved photographic sensitivity. A further object of the present invention is to provide a chromogenic photographic heat-transferable non-aqueous dye-diffusion-transfer photographic element of greater sensitometric uniformity.

These and other objects of the present invention are achieved in accordance with this invention by providing a process for forming a chromogenic photographic heat-transferable non-aqueous dye-diffusion-transfer photographic element comprising the steps of:

providing, separately, a melt comprising a spectrally dye sensitized silver halide emulsion and a dry diffusion transfer facilitating thermal solvent;

mixing said spectrally dye sensitized silver halide emulsion melt and said dry diffusion transfer facilitating thermal solvent with a mixing means to create a mixed melt;

providing a coating substrate; and coating said mixed melt on said substrate to form a coated photographic element, wherein said coating takes place less than about 10 minutes after mixing.

ADVANTAGEOUS EFFECTS OF THE INVENTION

We have found a way to prevent the very large variations in photographic sensitivity that are associated with the combination, in a single coating melt, of a dye sensitized silver halide emulsion and dry dye-diffusion-transfer facilitating materials described in the prior art. One advantage of using the processes of our invention is that chromogenic photographic heat-transferable non-aqueous dye-diffusion-transfer photographic elements can be prepared that are of higher photographic sensitivity than otherwise obtained. A further advantage of the present invention is to provide a chromogenic photographic heat-transferable non-aqueous dye-diffusion-transfer photographic element of greater sensitometric uniformity. The use of the processes of this invention will reduce materials waste in the course of forming chromogenic photographic heat-transferable non-aqueous dye-diffusion-transfer photographic elements.

DETAILED DESCRIPTION OF THE INVENTION

Figure 1:
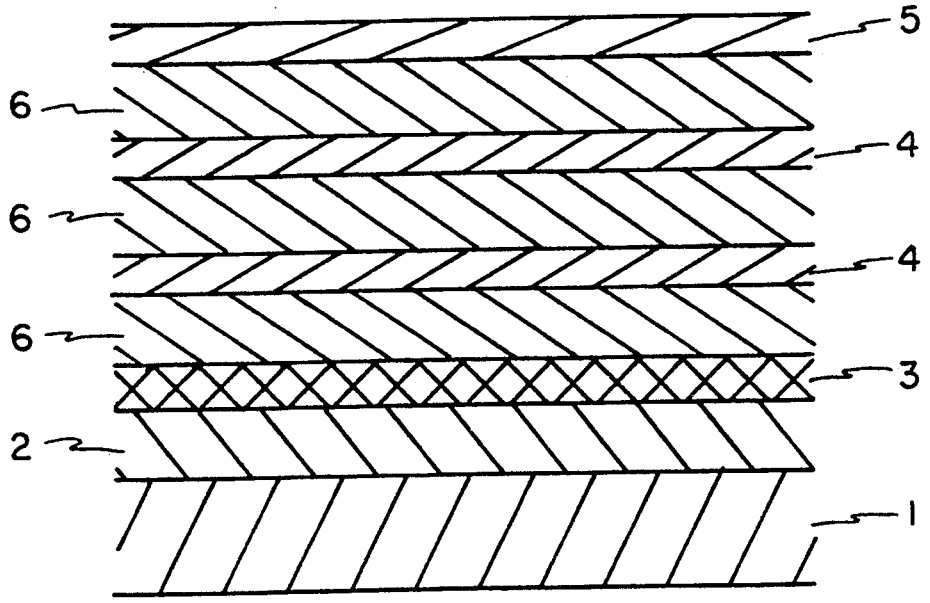
FIG. 1. Photographic element layer-structure for heat image separation system: 1—transparent or reflection base; 2—polymeric receiving layer; 3—stripping layer (optional); 4—interlayers; 5—protective overcoat layer; 6—diffusion transfer dye generation layers. The number of dye generation layers (6) is greater than or equal to one. Interlayers (4) between dye generation layers (6) are optional.
Figure 2:
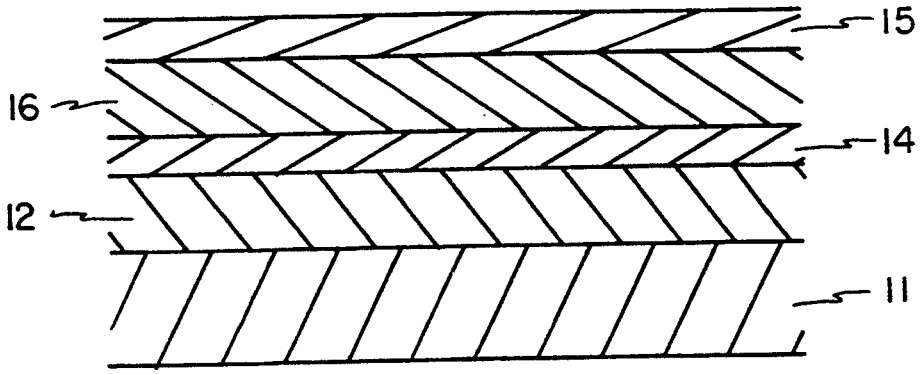
FIG. 2. Test coating format layer structure: 11—transparent or reflection base; 12—polymeric receiving layer; 14—interlayer containing gelatin and optionally thermal solvent; 15—protective overcoat layer; 16—diffusion transfer dye generation layer.

A novel method of imaging, whereby conventional wet development processes are utilized in combination with substantially dry thermally activated diffusion transfer of image dyes to a polymeric receiver has been described by Willis and Texter in commonly assigned U.S. Pat. No. 5,270,145 and hereby incorporated by reference. The methods and processes disclosed therein are incorporated herein by reference. The essential morphology of such an imaging system is illustrated in FIG. 1. It essentially consists of a conventional multilayer photographic element coated on a polymeric receiver element. The conventional element comprises one or more dye generation layers (6) and optionally one or more interlayers (4) and a protective overcoat (5) layer. This multilayer structure is coated on a receiver layer (2) with an optionally intervening stripping layer (3). The receiver layer (2) is coated on an appropriate transparent or reflection base (1). Images are created by conventional radiation sensitivities in the silver halide emulsion containing layers, and these images are amplified using conventional aqueous color development processes. The development is stopped with an appropriate wash or stop bath, and thereafter the element is dried. Preferred stop baths have an acidic pH. No fixing or bleaching chemistry need be invoked in this process, and bleaching, fixing, and bleach-fixing processing steps are omitted in preferred embodiments of the present invention process. After the elements have been dried, they are subjected to heating in order to drive the heat-transferable image dyes to the receiver layer. After such image transfer, the donor layers are removed and recycled, to recover silver and valuable fine organic compounds, and the receiver/base combination is retained as the final print material.

A substantial improvement in the imaging system, as disclosed by Bailey, Texter and White, U.S. patent application Ser. No. 08/804,868 filed Dec. 6, 1991; Bailey, Texter and White, U.S. patent application Ser. No. 08/073,821 filed Jun. 8, 1993; Bailey and Mura, U.S. patent application Ser. No. 08/073,825 filed Jun. 8, 1993; Bailey and Mura, U.S. patent application Ser. No. 08/073,822 filed Jun. 8, 1993; Bailey, Mura and Eiff, U.S. patent application Ser. No. 08/073,826 filed Jun. 8, 1993; and Bagchi and Bailey, U.S. patent application Ser. No. 08/159,022 filed Nov. 29, 1993, is obtained by the addition of certain materials to one or more of the layers that constitute the imaging element. The methods and processes disclosed in these patents and copending and coassigned applications are incorporated by reference.

Typical aqueous developable elements of the present invention are dried to remove excess water prior to heating to effect heat-transferable dye-diffusion transfer. This drying typically reduces the water content in such elements to less than 50% by weight relative to the hydrophilic binder present in said element. In preferred embodiments this drying reduces the water content to less than 20% by weight relative to the hydrophilic binder present.

We define the term "heat transferable" used herein as applied to image dyes to mean that said dyes will diffuse through hydrophilic binder when heated to temperatures in excess of 50° C. and when this hydrophilic binder is substantially dry with respect to the absorbed water, where the amount of absorbed water in this binder is less than 50% by weight relative to the binder and furthermore wherein said dyes are substantially insoluble and nondiffusible in aqueous medium of pH 7 to 13.

U.S. Pat. No. 5,164,286, Texter et al, hereby incorporated by reference, discloses a preferred method of separating receiver elements from the imaging layers. The thermal solvents of this invention are particularly effective in aiding the transfer of dyes formed by reaction of couplers with oxidized developer or by other means from imaging layers to a receiver element. The receiving element, containing the transferred dye image, is then separated from the imaging layers. Said separated receiving element constitutes the final print material.

In the present invention, thermal solvents are included in a chromogenic photographic heat-transferable dye-diffusion-transfer element, substantially dry and activated by heat, and comprising contacting dye-receiver and dye-donor layers. It has been found that the thermal solvents of our invention must have both a hydrogen bond donating functional group and a hydrogen bond accepting functional group as separate and distinct functional groups in the same compound. Thermal solvents are provided according to formula (I)

(I)

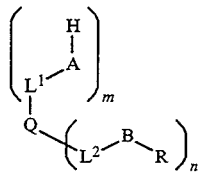

wherein

AH is a hydrogen bond donating group with an aqueous $pK_a$ value proton loss of greater than 6;

$L^1$ and $L^2$ are each independently divalent linking groups consisting of groups of 1 to 12 atoms or are independently absent;

m is 1, 2, or 3;

Q comprises a group of 2 to 15 carbon atoms selected from the group consisting of aromatic rings, alkyl chains, alkyl rings, or ring-chain combinations, optionally substituted with substituents, Z, consisting of alkyl groups or halogens;

B is a hydrogen bond accepting group with an aqueous $pK_a$ value for proton gain of less than 6, n is 1 or 2;

the groups AH and B cannot hydrogen bond to form a ring of either 5 or 6 atoms;

R is an alkyl, aryl and alkylaryl group of from 1 to 18 carbon atoms;

the calculated log of the octanol/water partition coefficient (clogP) is greater than 3 and less than 10.

These specific examples are meant to illustrate the invention and should not be construed as limiting the scope of the invention.

Examples of typical compounds according to formula (I) are generated from the structural components given in Table I by selection of;

one group from column Q, with selection of appropriate branching groups, $R^b$, from column $R^b$;

either 0, 1, 2, 3, or 4 groups from column Z, where Z is a substituent on an aromatic ring;

one AH—Q linking group $L^1$ from column $L^1$, $L^2$;

one proton donating group from column AH;

one Q—B linking group $L^2$ from column $L^1$, $L^2$ except for the example —OCH2— where the carbon bonding atom from B is not equal to carbon;

one hydrogen bond accepting group from column B, with selection of amine substituent groups, $R^b$, from column $R^b$;

and one group from column R;

such that the clogP of the resulting compound is greater than 3 and less than 10 and such that a hydrogen bonded ring of either 5 or 6 atoms cannot be formed between an atom in B and AH, as for example in salicylates.

In Table I the positional numbering of substituents, Z, are subordinate to that of $L^1$-A-H, which is defined as position 1, and to $L^2$-B-R which is defined in column Q.

TABLE I

Structural Compositions For Hydrogen Bond Donor/Acceptor Thermal Solvents
STRUCTURAL TABLE FOR EXAMPLES OF DRY DIFFUSION TRANSFER THERMAL SOLVENTS ACCORDING TO FORMULA (I).

| | AH (HBD) | Q | Z | L1, L2 | B (HBA) | $R^b$ | R |
|---|---|---|---|---|---|---|---|
| 1 | OH | 1,4-Phenyl | 4-$CH_3$ | • | O | H | methyl |
| 2 | $SO_2NHR^b$ | 1,3-Phenyl | 5-$CH_3$ | —$CH_2$— | S | methyl | ethyl |

TABLE I-continued

Structural Compositions For Hydrogen Bond Donor/Acceptor Thermal Solvents
STRUCTURAL TABLE FOR EXAMPLES OF DRY DIFFUSION TRANSFER THERMAL SOLVENTS ACCORDING TO FORMULA (I).

| | AH (HBD) | Q | Z | L1, L2 | B (HBA) | $R^b$ | R |
|---|---|---|---|---|---|---|---|
| 3 | $NHSO_2R^b$ | 1,2-Phenyl | 6-$CH_3$ | —$CH_2CH_2$— | C(=O)O | ethyl | 1-propyl |
| 4 | $NHSO_2$ CF3 | —$CH_2CH_2$— | 6-$CH_2Q$ | —$CH_2CH_2CH2$— | OC(=O) | 1-popyl | 2-propyl |
| 5 | | —$CR^b_2CR^b_2$— | 4-$CH_2CH_3$ | —CH(Me)$CH_2CH_2$— | C(=O) | 1-butyl | 1-butyl |
| 6 | | —$CH_2(CH_2)_3CH_2$— | 5-$CH_2CH_3$ | —CH=CH— | $NR^b$(C=O) | 1-butyl | 2-butyl |
| 7 | | —$CH_2CF_2CH_2$— | 4-$CH(CH_3)_2$ | —CH=$CHCH_2$— | C(=O)$NR^b$ | 1-pentyl | isobutyl |
| 8 | | 1,4-cyclohexyl | 6-$CH(CH_3)_2$ | —$CH_2CH(CH_2$—)$CH_2$— | OC(=O)O | 1-hexyl | 1-pentyl |
| 9 | | 1,3-cyclohexyl | 4-$CH_2C_2CH_3$ | —$OCH_2$— | OC(=O)$NR^b$ | benzyl | 1-hexyl |
| 10 | | 1,2-cyclohexyl | 5-$CH_2(CH_2)_2CH_3$ | —$OCH_2CH_2$— | $NR^b$C(=O)Oo | —$CH_2CH_2CH_2$— | 2-hexyl |
| 11 | | | 6-$CH_2(CH_2)_2CH_3$ | —OCH(Et)$CH_2$— | $NR^b$C(=O)$NR^b$ | | 1-(2-methyl) pentyl |
| 12 | | | 6-$C(CH_3)_3$ | | $OS(=O)_2$ | | 1-(2-ethyl) butyl |
| 13 | | | 4-$C(CH_3)_2CH_2(CH_3)_3$ | | $S(=O)_2O$ | | 1-heptyl |
| 14 | | | 4-$CH_2(CH_2)_6CH_3$ | | $S(=O)_2$ | | 1-octyl |
| 15 | | | 4-Cl | | $NR^bS(=O)_2$ | | 1-(2-ethyl) hexyl |
| 16 | | | 5-Cl | | $S(=O)_2NR^b$ | | 1,8-octyl-(bis) |
| 17 | | | 6-Cl | | $OS(=O)_2O$ | | tert-octyl |
| 18 | | | | | $OS(=O)_2NR^b$ | | 1-nonyl |
| 19 | | | | | $NR^bS(=O)_2O$ | | 1-(3,5,5-tri-Me) hexyl |
| 20 | | | | | $NR^bS(=O)_2NR^b$ | | 1-decyl |
| 21 | | | | | $NR^bCH_2S(=O)_2$ | | 1-(3,7-dimethyl) octyl |
| 22 | | | | | OP(=O)-(—O—)$_2$ | | 1,10-decyl-(bis) |
| 23 | | | | | | | 1-undecyl |
| 24 | | | | | | | 1-dodecyl |
| 25 | | | | | | | 1-(2-butyl) octyl |
| 26 | | | | | | | 1-tridecyl |
| 27 | | | | | | | 1-tetradecyl |
| 28 | | | | | | | 1-(2-hexyl) decyl |
| 29 | | | | | | | benzyl |
| 30 | | | | | | | 1-ethyl-phenyl |
| 31 | | | | | | | 1-propyl-phenyl |
| 32 | | | | | | | phenyl |

(Notes: $R^b$ not H)

Specific examples of suitable structures according to formula (I) are shown in Table II.

TABLE II

Example Dry Dye Diffusion Transfer Facilitating Thermal Solvents

| | | | | | HBA Unit | | | | |
|---|---|---|---|---|---|---|---|---|---|
| Cmpd. | AH | $L_{(1)}$ | Q | Z | Pos. | Link, $L_{(2)}$ | HBA | R | cLogP |
| II-1 | OH | • | phenyl | • | 4 | • | C(=O)O | 1-octyl | 5.688 |
| II-2 | OH | • | phenyl | • | 4 | • | C(=O)O | 1-decyl | 6.746 |
| II-3 | OH | • | phenyl | • | 4 | —CH2CH2— | C(=O)O | 1-octyl | 5.125 |
| II-4 | OH | • | phenyl | • | 4 | —OCH2— | C(=O)O | 1-decyl | 5.926 |
| II-5 | OH | • | phenyl | • | 4 | —CH2CH2CH2— | OC(=O) | 1-nonyl | 6.183 |
| II-6 | OH | • | phenyl | • | 3 | • | C(=O)O | 1-octyl | 5.125 |
| II-7 | OH | • | phenyl | • | 4 | • | C(=O)NH | 1-dodecyl | 6.352 |
| II-8 | OH | • | phenyl | • | 4 | • | SO2 | 1-decyl | 5.284 |
| II-9 | OH | • | phenyl | • | 4 | • | SO2 | 1-dodecyl | 6.342 |
| II-10 | OH | • | phenyl | • | 4 | • | SO2NH | 1-decyl | 5.280 |
| II-11 | OH | • | phenyl | • | 4 | • | SO2NH | 1-dodecyl | 6.338 |
| II-12 | OH | • | phenyl | • | 4 | • | O | 1-nonyl | 5.806 |
| II-13 | OH | • | phenyl | • | 4 | • | S | 1-octyl | 5.737 |
| II-14 | OH | • | phenyl | • | 4 | • | S | 1-decyl | 6.795 |

TABLE II-continued

Example Dry Dye Diffusion Transfer Facilitating Thermal Solvents

| Cmpd. | AH | $L_{(1)}$ | Q | Z | HBA Unit Pos. | HBA Unit Link, $L_{(2)}$ | HBA Unit HBA | R | cLogP |
|---|---|---|---|---|---|---|---|---|---|
| II-15 | OH | —CH2— | phenyl | • | 4 | • | C(=O)O | 1-octyl | 4.776 |
| II-16 | OH | —CH2— | phenyl | • | 4 | —CH2CH2— | OC(=O) | 1-octyl | 4.754 |
| II-17 | OH | —CH2— | phenyl | • | 4 | • | SO2 | 1-dodecyl | 5.282 |
| II-18 | OH | —OCH2CH2— | phenyl | • | 4 | • | C(=O)O | 1-octyl | 5.161 |
| II-19 | OH | —OCH2CH2— | phenyl | • | 4 | • | SO2 | 1-dodecyl | 5.691 |
| II-20 | OH | —OCH2CH2— | phenyl | • | 4 | —CH2CH2— | C(=O)O | 1-octyl | 5.896 |
| II-21 | OH | —OCH2CH2— | phenyl | • | 4 | —CH2CH2— | SO2NH | 1-decyl | 5.187 |
| II-22 | OH | —CH2OCH2CH2— | cyclohexyl | • | 4 | —CH2— | C(=O)O | 1-decyl | 5.045 |
| II-23 | OH | —CH2— | cyclobexyl | • | 4 | —CH2— | OC(=O) | 1-octyl | 5.027 |
| II-24 | OH | —CH2— | cyclohexyl | • | 4 | —CH2— | SO2 | 1-decyl | 4.525 |
| II-25 | OH | • | 1,8-octyl | • | 8 | • | OC(=O) | 1-octyl | 5.561 |

An alternative group of non-aqueous dye-diffusion transfer facilitating thermal solvents are comprised of amphiphilic molecules with both hydrophilic and hydrophobic moieties. Such compounds as defined in the following aid the transfer of dye molecules to the receiver layer of the photographic element of this invention. Said non-aqueous dye-diffusion transfer facilitating thermal solvent is a surfactant sugar group containing amphiphilic compound comprising between one to three independently constituted 3 to 22 carbon atom hydrophobic tail(s) with one or more attached hydrophilic mono or oligosaccharidic rings or chains such that the HLB value of the compounds is less than about 13.

Specific examples of suitable thermal solvent surfactants for the practice of this invention are listed in Table III as follows:

TABLE III

Examples of Surfactant Thermal Solvents

SSTS-1

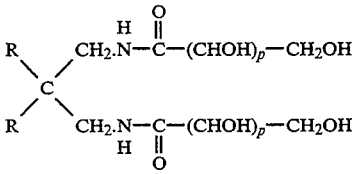

where,
R = n-$CH_3(CH2)_n$— (where n = 2 to 12), or

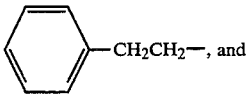

p = 3 to 10.

SSTS-2

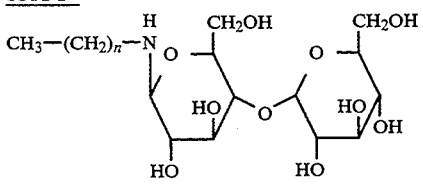

where, n = 5 to 21.

SSTS-3

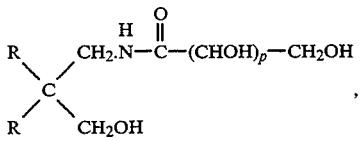

, where
R = n-$CH_3(CH2)_n$— (where n = 2 to 12), or

TABLE III-continued

Examples of Surfactant Thermal Solvents

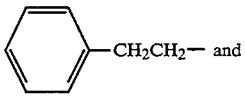

p = 3 to 10.

SSTS-4

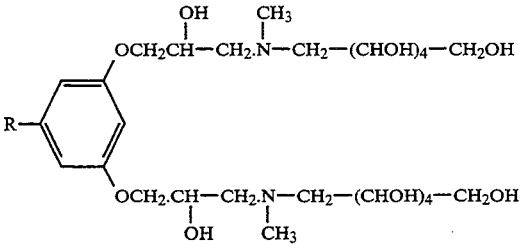

R = n-$CH_3(CH2)_n$— (where n = 5 to 15).

SSTS-5

$CH_3(CH_2)_nOCH_2CH(OH)CH_2NHC(=O)(CHOH)_4CH_2OH$
where, n = 5 to 21.

SSTS-6

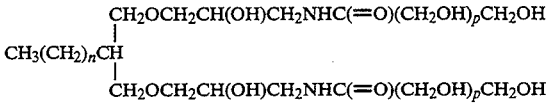

where,
n = 4 to 20
p = 3 to 10.

SSTS-7

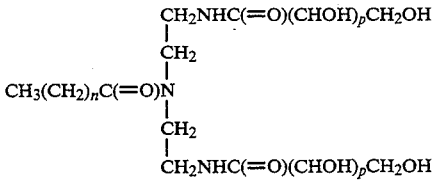

where,
n = 5 to 21
p = 3 to 10.

SSTS-8

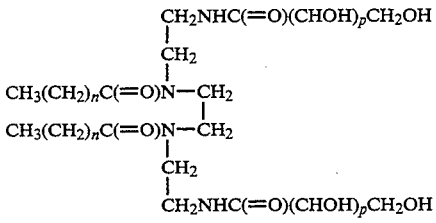

TABLE III-continued

Examples of Surfactant Thermal Solvents where,
n = 2 to 21
p = 3 to 10.

SSTS-9

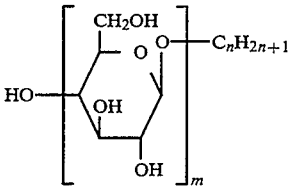

where,
n = 6 to 22
m = 1 to 4.

SSTS-10

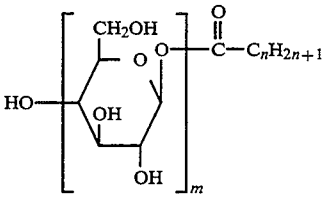

where,
n = 6 to 22
m = 1 to 4.

SSTS-11

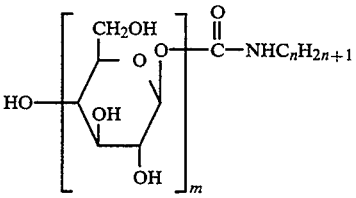

where,
n = 6 to 22
m = 1 to 4.

The most preferred amphiphilic molecules for this invention, compound SSTS-9, where the average values for m are 1.4 and for n are 12.8. Compounds of structures SSTS-9 and SSTS-10 are usually commercially available and are usually composed of mixture of compounds with a spread in the values of m and n. Therefore, specific examples such as the most preferred compound cited above have fractional values for m and n. This commercial material of the preferred embodiment is trade named APG-600 manufactured by Henkel Corporation, Cincinnati, Ohio, U.S.A.

Of these amphiphilic molecules that are commercially available and inexpensive the ones that are particularly effective as thermal solvents are the one that have a "Hydrophilic-Lipophilic Balance" (HLB) value of less than about 13. Hydrophilic-Lipophilic Balance is a numeric rating system for the combined hydrophilic and lipophilic characteristics of an amphiphilic molecule that contains both hydrophilic and lipophilic moieties. The assignment of numeric values based upon chemical groupings in a molecule is given by A. W. Adamson in "Physical Chemistry of Surfactants," Interscience Publishers, New York, 1967 (2nd Ed.) pages 520 to 522. Adamson also provides references to experimental methods for the determination of HLB numbers of amphiphilic molecules.

Binders that can be employed in the aqueous developable photographic element of the present invention are described in *Research Disclosure,* Item No. 17643, p. 26 (December, 1978) and *Research Disclosure,* Item No. 308199, pp. 1003–1004 (December, 1989) and include: synthetic high-molecular weight compounds such as polyvinylbutyral, polyvinyl acetate, ethyl cellulose, cellulose acetate butyrate, polyvinyl alcohol and polyvinylpyrrolidone; synthetic or natural high-molecular weight compounds such as gelatin, gelatin derivatives (e.g., phthalated gelatin), cellulose derivatives, proteins, starches, and gum arabic. These high-molecular weight compounds may be used either singly or in combination. It is particularly preferred to employ gelatin.

The binders are generally used in amounts ranging from 0.05 to 50 g, preferably from 0.2 to 20 g, per square meter of the base support. The binders are preferably used in amounts of 0.1–10 g, more preferably 0.2–5 g, per gram of the dye-providing material.

Couplers may be either four-equivalent, losing two hydrogen atoms from the coupling site during reaction with oxidized color developer, or formally two-equivalent, having a coupling-off group that is lost from the coupler during reaction with the oxidized color developer to form a dye. The coupler fragment that bears the coupling-off group and that forms the dye with the oxidized color developer is referred to as the coupler parent. Coupling-off groups are well known in the art and include, for example, alkylthio, arylthio, aryloxy, N-linked nitrogen heterocycles and chlorine. It is generally preferred in color photographic elements that the molecular weight of the couplers be above 600 (all molecular weights herein are expressed in atomic mass units). The typical molecular weight for these couplers is between 700 and 1100.

The coupler compound contained in the aqueous developable color photographic elements of the present invention may be any coupler designed to be developable by color developer solutions, and to form a heat transferable dye upon such development. While color images may be formed with coupler compounds which form dyes of essentially any hue, couplers which form heat transferable cyan, magenta, or yellow dyes upon reaction with oxidized color developing agents are used in preferred embodiments of the invention. Suitable couplers for this invention are disclosed by Willis and Texter in U.S. Ser. No. 804,877, filed Dec. 6, 1991. Preferred couplers for this invention are those that have a coupling-off group. Further, it is preferred that the molecular weight of the parent portion of the coupler be in the range of 90 to 600 and more preferably in the range of 110 to 500 so that the resulting dyes have increased diffusibility. The molecular weight of the entire coupler compound can be adjusted to a selected value by variation to the coupling-off group structure. Couplers that have no readily ionizable functional groups such as sulfonic acids, carboxylic acids, very strongly acidic phenols, or very strongly acidic sulfonamides are preferred in this invention so that their interaction with dry hydrophilic binder, especially gelatin, is minimized.

Suitable heat transferable dye forming compounds of the present invention provide heat transferable dyes that are devoid of functional groups with aqueous $pK_a$ values for proton loss of less than 9. Preferred heat transferable dye forming compounds of the present invention provide heat transferable dyes that are devoid of functional groups with aqueous pKa values for proton loss of less than 6. In preferred embodiments of the elements of the present invention heat-transferable dye-diffusion transfer is not significantly facilitated at 40° C. and below by wetting with aqueous alkali.

Dye-forming compounds contained in the element of our invention may be linked to a polymer structure so that on reaction with oxidized color developer the dye is chemically released from the polymer. Dye-forming compounds that are linked to polymers through the coupling site are a preferred class of compounds in our invention. Image dye-forming compounds linked to polymers so that the dye remains chemically bound to the polymer are not preferred in this invention because the dye will not readily transfer to the dye receiver layer.

The dye transfer facilitating thermal solvents of this invention may be contained in the same layer as that containing the heat-transferable dye-forming compound or in layers not containing these dye-forming compounds. In elements of two or more layers the thermal solvents of our invention may be contained in any, some or all layers of the element. The dye transfer facilitating thermal solvents of our invention are preferably employed at a loading of between 0 and 300% of the hydrophilic binder in each layer in the photographic element, or more preferably between 0 and 150% of the hydrophilic binder in each layer. Further, the amount of dye transfer facilitating thermal solvent in the element is preferred to be between 10 and 200% of the hydrophilic binder in the element, or more preferably between 15 and 120% of the hydrophilic binder in the element. The thermal solvents of our invention are preferably employed at a level of between 100 to 3000 mg/m$^2$ for photographic elements having only a single color record, between 200 and 4500 mg/m$^2$ for photographic elements having only two color records and between 400 and 6000 mg/m$^2$ for photographic elements comprising three color records.

The photographic elements of our invention may contain high boiling solvents, known in the art as coupler solvents. These high boiling solvents can be employed in dispersions of the heat-transferable dye-forming compounds, interlayer scavengers, thermal solvents, or other compounds contained in the photographic element. The dye-forming compounds in the photographic elements of our invention may be employed without the use of high boiling solvents. These high boiling solvents may increase the reactivity of the heat-transferable dye-forming compound, improve the stability of the dispersion of the dye-forming compound, or may improve the transfer of heat-transferable dye from the dye generation layer to the dye receiver layer. Such high boiling solvents may be selected from any of these compounds known in the art. Coupler solvents may be contained in the dispersions of the dye-forming compounds at amounts between 0 and 400% of the dye-forming compound. High boiling solvents may be contained in dispersions of the dye transfer facilitating thermal solvents of our invention at amounts between 0 and 100% of the thermal solvent. These high boiling solvents may be dispersed with other addenda contained in the photographic element.

The primary amine developing agents useful in the practice of this invention are selected from the p-amino-N,N-dialkylanilines known in the art of color photography. Examples of these compounds are described, for example, by R. L. Bent et al. (*Photo. Sci. Eng.*, 1963, 8, 125). Primary amine developing agents that have no readily ionizable functional groups such as sulfonic acids or carboxylic acids are preferred in this invention so that the interaction between dry hydrophilic binder, especially gelatin, and the heat-transferable dye formed by the reaction with the dye-forming compound is minimized.

The aqueous developer solution may contain compounds to stabilize the developing agents against oxidation, compounds to minimize precipitation of development products, brightening agents and other compounds to maintain the stability of the developer prior to and during use. The aqueous developer solution can be employed at a wide range of temperatures but is preferred to be in the range of 15° to 55° C. The pH of the aqueous developer solution can be in the range of 8 to 12 with a preferred range of 9 to 11.

A typical multilayer, multicolor photographic element to be used with the thermal solvents of this invention comprises a support having thereon a red-sensitive silver halide emulsion layer having associated therewith a heat-transferable cyan dye image forming coupler compound, a green-sensitive silver halide emulsion layer having associated therewith a heat-transferable magenta dye image forming coupler compound and a blue-sensitive silver halide emulsion layer having associated therewith a heat-transferable yellow dye image forming coupler compound. Each silver halide emulsion layer can be composed of one or more layers and the layers can be arranged in different locations with respect to one another. Typical arrangements are described in *Research Disclosure,* Item No. 308199, (December, 1989) the disclosure of which is incorporated by reference.

The light sensitive silver halide emulsions can include coarse, regular or fine grain silver halide crystals of any shape or mixtures thereof and can be comprised of such silver halides as silver chloride, silver bromide, silver bromoiodide, silver chlorobromide, silver chloroiodide, silver chlorobromoiodide and mixtures thereof. The emulsions can be negative working or direct positive emulsions. They can form latent images predominantly on the surface of the silver halide grains or pre-dominantly on the interior of the silver halide grains. They can be chemically or spectrally sensitized. The emulsions typically will be gelatin emulsions although other hydrophilic colloids as disclosed in *Research Disclosure,* Item No. 308199, (December, 1989) can be used in accordance with usual practice.

Silver halide emulsions can be spectrally sensitized with dyes from variety of classes, including the polymethine dye class which includes the cyanines, merocyanines, complex cyanines and merocyanines, oxonols, hemioxonaols, styryls, merostyryls and streptocyanines. Known materials and methods of spectral sensitization of silver halide emulsions are disclosed in *Research Disclosure,* Issue 308, Item No. 308119 (December, 1989). Examples of some preferred spectral sensitizing dyes, SB-1, SB-2, SG-1 and SR-1 are shown below.

SB-1

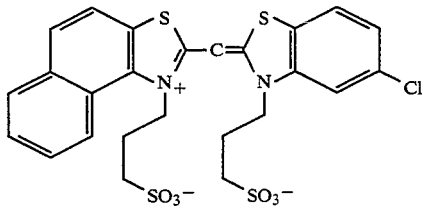

-continued

SB-2

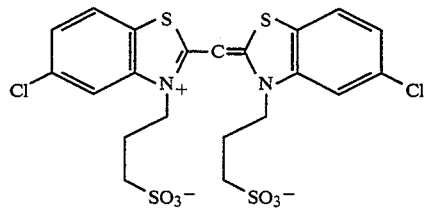

SG-1

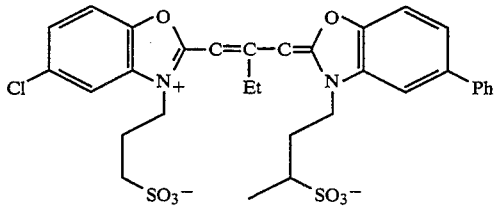

SR-1

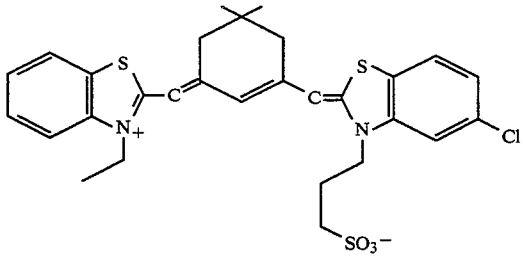

The methods and materials for chemical sensitization of silver halide emulsions are well established in the art of photography. Numerous reviews and summaries of the techniques and materials and the photographic consequences of chemical sensitization have been published including "The Theory of the Photographic Process, 4th Ed.", Chapter 5, edited by T. H. James and published by Macmillan Publishing Co, New York (1977). Known materials and methods of chemical sensitization and the use of various antifoggants and stabilizers employed to obtain improvements in photographic characteristics are disclosed in *Research Disclosure,* Issue 308, Item No. 308119 (December, 1989).

A particular example of chemical sensitization disclosed, for example, by Davey and Knott in U.S. Pat. No. 2,592,250 (Apr. 8, 1952) is termed halide conversion and the silver halide emulsions so obtained as "converted-halide". The terms "halide conversion" and "converted-halide" are used as words of art. This consists of treating a completed emulsion with an alkali halide solution capable of forming a less soluble silver salt than the original silver halide emulsion as discussed by Maskasky in U.S. Pat. No. 4,142,900. For example, in the case of silver chloride emulsions subsequently treated with a doctor solution of alkali bromide as described, for example, by Deaton in U.S. Pat. No. 5,049,485 there is advantageously obtained improvements in stability to development fog and in spectral sensitizing dye adsorption as disclosed in *Research Disclosure,* Issue 176, Item No. 18716 (November, 1979).

Further improvements in the spectrally sensitized photographic sensitivity of the elements of our invention can be obtained by the treatment or doctoring of the silver chloride emulsions with alkali halide solutions to convert a portion of the silver chloride emulsion to a less soluble silver halide. Fine grain silver bromide emulsions can be used in place of or in combination with the soluble alkali halide to obtain improvements in spectrally sensitized silver chloride properties.

Especially useful in this invention are tabular grain silver halide emulsions. Suitable tabular grain emulsions can be selected from among a variety of conventional teachings, such as those of the following: *Research Disclosure,* No. 22534, (January, 1983); U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. More preferred in this invention are tabular silver chloride grains such as disclosed in U.S. Pat. Nos. 5,176,991; 5,176,992; 5,178,998; 5,183,732; 5,185,239 and EP 0534395.

The support can be of any suitable material used with photographic elements. Typically, a flexible support is employed, such as a polymeric film or paper support. Such supports include cellulose nitrate, cellulose acetate, polyvinyl acetal, poly(ethylene terephthalate), polycarbonate, white polyester (polyester with white pigment incorporated therein) and other resinous materials as well as glass, paper or metal. Paper supports can be acetylated or coated with polymer of an alpha-olefin containing 2 to 10 carbon atoms such as polyethylene, polypropylene or ethylene butene copolymers. The support may be any desired thickness, depending upon the desired end use of the element. In general, polymeric supports are usually from about 3 μm to about 200 μm in thickness and paper supports are generally from about 50 μm to about 1000 μm in thickness.

The dye-receiving layer to which the formed heat-transferable dye image is transferred according to the invention may be coated on the photographic element between the emulsion layer and support, or may be in a separate dye-receiving element which is brought into contact with the photographic element during the dye transfer step. If present in a separate receiving element, the dye receiving layer may be coated or laminated to a support such as those described for the photographic element support above, or may be self-supporting. In a preferred embodiment of the invention, the dye-receiving layer is present between the support and any silver halide emulsion layer of an integral photographic element.

The dye receiving layer may comprise any material effective at receiving the heat transferable dye image. Examples of suitable receiver materials include polycarbonates, polyurethanes, polyesters, polyvinyl chlorides, poly (styrene-co-acrylonitrile)s, poly(caprolactone)s and mixtures thereof. The dye receiving layer may be present in any amount which is effective for the intended purpose. In general, good results have been obtained at a concentration of from about 1 to about 10 $g/m^2$ when coated on a support. In a preferred embodiment of the invention, the dye receiving layer comprises a polycarbonate. The term "polycarbonate" as used herein means a polyester of carbonic acid and a glycol or a dihydric phenol. Examples of such glycols or dihydric phenols are p-xylylene glycol, 2,2-bis(4-oxyphenyl)propane, bis(4-oxyphenyl) methane, 1,1-bis (4-oxyphenyl) ethane, 1,1-bis (oxyphenyl)butane, 1,1-bisphenol-A polycarbonate having a number average molecular weight of at least about 25,000. Examples of preferred polycarbonates include General Electric LEXAN® Polycarbonate Resin and Bayer AG MACROLON® 5700. Further, a thermal dye transfer overcoat polymer as described in U.S. Pat. No. 4,775,657 may also be used.

Heating times of from about 10 seconds to 30 minutes at temperatures of from about 50°0 to 200° C. (more preferably 75° to 160° C., and most preferably 80° to 120° C.) are preferably used to activate the thermal transfer process. This aspect makes it possible to use receiver polymers that have a relatively high glass transition temperature (Tg) (e.g., greater than 100° C.) and still effect good transfer, while minimizing back transfer of dye (diffusion of dye out of the receiver onto or into a contact material).

While essentially any heat source which provides sufficient heat to effect transfer of the developed heat-transferable dye image from the emulsion layer to the dye receiving layer may be used, in a preferred embodiment dye transfer is effected by running the developed photographic element with the dye receiving layer (as an integral layer in the photographic element or as part of a separate dye receiving element) through a heated roller nip. Thermal activation transport speeds of 0.1 to 50 cm/sec are preferred to effect transfer at nip pressures of from about 500 Pa to 1,000 kPa and nip temperatures of from about 75° to 190° C.

In preferred embodiments of the aqueous developable elements of the present invention containing an integral receiver the amount of heat-transferable dye density transferred through drying is less than 15% of the total dye density transferable through drying and heating.

Another preferred method of imaging combines thermal or heat development of radiation sensitive silver halide, usually in the presence of an organic silver salt and an incorporated reducing agent, with thermally activated diffusion transfer of image dyes to a polymeric receiver. Such systems are described in U.S. Pat. Nos. 4,584,267, 4,590,154, 4,595,652, 4,770,981, 4,871,647, 4,948,698, 4,952,479, and 4,983,502, the disclosures of which are incorporated herein by reference. Such materials generally comprise a plurality of radiation sensitive layers. A typical radiation sensitive layer comprises radiation sensitive silver halide, an organic silver salt, a reducing agent, a dye forming or donating compound, a binder, and in preferred embodiments, one or more thermal solvents to facilitate the heat development of the silver halide and organic silver salt and the transfer of the resulting image dye to a suitable receiving element. In preferred multilayer materials, radiation sensitive layers sensitive to blue, green, and red light are included that produce yellow, magenta, and cyan heat-transferable image dyes for diffusion transfer, respectively. Thermal solvents and heat solvents of the type disclosed in the aforesaid U.S. Patent documents and disclosed herein by reference are included to facilitate heat development and thermal dye transfer. The preferred thermal solvents of the present invention serve to facilitate the thermal dye transfer of dyes through the binder to the receiver element.

The coupler compound to be used in this process of the invention may be any dye forming, dye providing, or dye donating material that will produce a heat transferable dye upon heat development. Preferred dye forming compounds are those that provide heat transferable cyan, magenta, or yellow dyes upon heat development.

The dye-providing materials of the present invention may be used either on their own or as admixtures. If desired, they may be used in combination with dye-providing materials of the type described in such patents as U.S. Pat. Nos. 4,631,251, 4,656,124, and 4,650,748.

The amount of the dye-providing materials used is not limited and may be determined according to their type, the manner in which they are used (i.e., either singly or in combination) or the number of photographic constituent layers of which the heat-processible photographic material of the present invention is composed (i.e., a single layer or two or more layers in superposition). As a guide, the dye-providing materials may be used in an amount of 0.005–50 g, preferably 0.1–10 g, per square meter. The dye-providing materials for use in the present invention may be incorporated in photographic constituent layers of the heat-processible photographic material by any suitable method.

The light-sensitive silver halide to be used in the present invention may include, for example, silver chloride, silver bromide, silver iodide, silver chlorobromide, silver chloroiodide and silver iodobromide. Such light-sensitive silver halides can be prepared by any of the methods commonly employed in the photographic art.

If desired, a silver halide emulsion having silver halide grains with a duplex structure (i.e., the halide composition of the grain surface differing from that of the interior) may be used and an example of such duplex grains is core/shell type silver halide grains. The shell of these grains may change in halide composition stepwise or gradually. The silver halide grains used may have a well-defined crystal habit as in cubes, spheres, octahedra, dodecahedra or tetradecahedra. Alternatively, they may not have any well-defined crystal shape. The silver halide grains in these light-sensitive emulsions may be coarse or fine; preferred grain sizes are on the order of 0.005 μm to 1.5 μm in diameter, with the range of from about 0.01 to about 0.5 μm being more preferred.

According to another method for preparing light-sensitive silver halides, a light-sensitive silver salt forming component may be used in the presence of organic silver salts (to be described below) so as to form light-sensitive silver halides in part of the organic silver salts.

These light-sensitive silver halides and light-sensitive silver salt forming component may be used in combination in a variety of methods, and the amount used in one photographic layer preferably ranges from 0.001 to 50 g, preferably 0.1–10 g, per square meter of base support.

The light-sensitive silver halide emulsions illustrated above may be chemically sensitized by any of the methods commonly employed in the photographic art. The light-sensitive silver halide emulsions to be used in the present invention may be spectrally sensitized with known spectral sensitizers in order to provide sensitivity to the blue, green, red, or near-infrared region.

Typical examples of the spectral sensitizers that can be used in the present invention include cyanine dyes, merocyanine dyes, complex (tri- or tetra-nuclear) cyanine dyes, holopolar cyanine dyes, styryl dyes, hemicyanine dyes and oxonol dyes. These sensitizers are incorporated in amounts ranging from $1\times10^{-4}$ to 1 mole, preferably from $1\times10^{-4}$ to $1\times10^{-1}$ mole, per mole of the light-sensitive silver halide or silver halide forming component. The sensitizers may be added at any stage of the preparation of silver halide emulsions; they may be added during the formation of silver halide grains, during the removal of soluble salts, before the start of chemical sensitization, during chemical sensitization or after completion of the chemical sensitization.

A variety of organic silver salts may optionally be employed in the heat-processible photographic material of the present invention in order to increase its sensitivity or improve its developability.

Illustrating organic silver salts that may be employed in the heat-processible photographic material of the present invention include: silver salts of long-chain aliphatic carboxylic acids and silver salts of carboxylic acids having a hetero ring, such as silver behenate and silver α-(1-phenyltetrazolethio) acetate (see U.S. Pat. Nos. 3,330,633, 3,794,496 and 4,105,451); and silver salts of an imino group as described in U.S. Pat. No. 4,123,274.

Among the organic silver salts listed above, silver salts of an imino group are preferred. Particularly preferred are silver salts of benzotriazole derivatives such as 5-methylbenzotriazole or derivatives thereof, sulfobenzotriazole or derivatives thereof and N-alkylsulfamoylbenzotriazole or derivatives thereof.

These organic silver salts may be used either singly or as admixtures in the present invention. Silver salts prepared in suitable binders may be immediately used without being isolated. Alternatively, isolated silver salts may be dispersed in binders by suitable means before they are used. The organic silver salts are preferably used in amounts ranging from 0.01 to 500 moles, more preferably from 0.1 to 100 moles, most preferably from 0.3 to 30 moles, per mole of the light-sensitive silver halide.

The reducing agent for use in the heat-processible photographic material of the present invention (the term "reducing agent" as used herein shall include precursors of the reducing agent) may be selected from among those which are commonly employed in the field of heat-processible photographic materials.

Reducing agents that can be used in the present invention include: p-phenylenediamine developing agents or their precursors, p-aminophenolic developing agents, phosphoroamidophenolic developing agents, sulfonamidoaniline-based developing agents, hydrazone-based color developing agents, and precursors of these developing agents, such as those described in U.S. Pat. Nos. 3,531,286, 3,761,270, and 3,764,328. Also useful are phenols, sulfonamidophenols, polyhydroxybenzenes, naphthols, hydroxybinaphthyls, methylenebisnaphthols, methylenebisphenols, ascorbic acids, 3-pyrazolidones, pyrazolones, etc. The reducing agents may be used either on their own or as admixtures. The amount in which the reducing agents are used in the heat-processible photographic material of the present invention depend upon many factors such as the type of light-sensitive silver halide used, the type of organic acid silver salt, and the type of other additives used. Usually, the reducing agents are used in amounts ranging from 0.01 to 1,500 moles per mole of light-sensitive silver halide, with the range of 0.1–200 moles being preferred.

Illustrative binders that can be employed in the heat-processible photographic material of the present invention include: synthetic high-molecular weight compounds such as polyvinylbutyral, polyvinyl acetate, ethyl cellulose, polymethyl methacrylate, cellulose acetate butyrate, polyvinyl alcohol and polyvinylpyrrolidone; synthetic or natural high-molecular weight compounds such as gelatin, gelatin derivatives (e.g., phthalated gelatin), cellulose derivatives, proteins, starches, and gum arabic. These high-molecular weight compounds may be used either singly or in combination. It is particularly preferred to employ gelatin or its derivatives in combination with synthetic hydrophilic polymers such as polyvinylpyrrolidone and polyvinyl alcohol. A more preferred binder is a mixture of gelatin and polyvinylpyrrolidone.

The binders are generally used in amounts ranging from 0.05 to 50 g, preferably from 0.2 to 20 g, per square meter of the base support. The binders are preferably used in amounts of 0.1–10 g, more preferably 0.2–5 g, per gram of the dye-providing material.

The heat-processible photographic material of the present invention is produced by forming photographic constituent layers on a base support. A variety of base supports can be used and they include: synthetic plastic films such as a polyethylene film, a cellulose acetate film, a polyethylene terephthalate film, and a polyvinyl chloride film; paper bases such as photographic raw paper, printing paper, baryta paper and resin-coated paper; and base prepared by coating these materials with electron-beam curable resin compositions, followed by curing of the same.

The heat-processible photographic material of the present invention is suitable for processing by transfer photography using an image-receiving member. In the practice of the present invention, a variety of thermal solvents are preferably incorporated in the heat-processible photographic material and/or the image-receiving member.

Particularly useful thermal solvents are urea derivatives (e.g., dimethylurea, diethylurea and phenylurea), amide derivatives (e.g., acetamide, benzamide and p-toluamide), sulfonamide derivatives (e.g., benzenesulfonamide and α-toluene-sulfonamide), and polyhydric alcohols (e.g., 1,6-hexanediol, 1,2-cyclohexanediol and pentaerythritol, and polyethylene glycol. Water-insoluble solid thermal solvents may be used with particular advantage.

Thermal solvents may be incorporated in various layers such as light-sensitive silver halide emulsion layers, intermediate layers, protective layers, and image-receiving layers in an image-receiving member so that the results desired in respective cases can be obtained.

Thermal solvents are usually incorporated in amounts ranging from 10 to 500 wt %, preferably from 30 to 200 wt %, of the binder in the element.

The organic silver salts and thermal solvents may be dispersed in the same liquid dispersion system. The binder, dispersion medium and dispersing apparatus used in this case may be the same as those employed in preparing the respective liquid dispersions.

Besides the components described above, the heat-processible photographic material of the present invention may incorporate various other additives such as development accelerators, antifoggants, base precursors, etc.

Illustrative base precursors include compounds that undergo decarboxylation upon heating to release a basic substance (e.g., guanidium trichloroacetate) and compounds that are decomposed by reactions such as intramolecular nucleophilic substitution reaction to release amines. Other additives that are used as required in heat-processible photographic materials may also be incorporated in the heat-processible photographic material of the present invention. Illustrative additives include antihalation dyes, brighteners, hardeners, antistats, plasticizers, extenders, matting agents, surface-active agents and antifading agents. These additives may be incorporated not only into light-sensitive layers but also into non-light-sensitive layers such as intermediate layers, protective layers and backing layers.

The heat-processible photographic material of the present invention contains (a) a light-sensitive silver halide, (b) a reducing agent, (c) a binder and (d) the dye-providing material of the present invention. Preferably, it further contains (e) an organic silver salt as required. In a basic mode, these components may be incorporated in one heat-processible light-sensitive layer but it should be noted that they are not necessarily incorporated in a single photographic constituent layer but may be incorporated in two or more constituent layers in such a way that they are held mutually reactive. In one instance, a heat-processible light-sensitive layer is divided into two sub-layers and components (a), (b), (c) and (e) are incorporated in one sub-layer with the dye-providing material (d) being incorporated in the other sub-layer which is adjacent to the first sub-layer. The heat-processible light-sensitive layer may be divided into two or more layers including a highly sensitive layer and a less sensitive layer, or a high-density layer and a low-density layer.

The heat-processible photographic material of the present invention has one or more heat-processible light-sensitive layers on a base support. If it is to be used as a full-color light-sensitive material, the heat-processible photographic material of the invention generally has three heat-processible light-sensitive layers having different color sensitivities, each light-sensitive layer forming or releasing a dye of different color as a result of thermal development. A blue-sensitive layer is usually combined with a yellow dye, a green-sensitive layer with a magenta dye, and a red-sensitive layer with a cyan dye, but different combination may be used.

The choice of layer arrangements depends on the objective of a specific use. For instance, a base support is coated with a red-sensitive, a green-sensitive and a blue-sensitive layer, or in the reverse order (i.e., a blue-sensitive, a green-sensitive and a red-sensitive layer), or the support may be coated with a green-sensitive, a red-sensitive and a blue-sensitive layer.

Besides the heat-processible light-sensitive layers described above, the heat-processible photographic material of the present invention may incorporate non-light-sensitive layers such as a subbing layer, an intermediate layer, a protective layer, a filter layer, a backing layer and a release layer. The heat-processible light-sensitive layers and these non-light-sensitive layers may be applied to a base support by coating techniques that are similar to those commonly employed to coat and prepare ordinary silver halide photographic materials.

The heat-processible photographic material of the present invention is developed after imagewise exposure and this can usually be done by merely heating the material at a temperature in the range of 80°–200° C., preferably 100°–170° C., for a period of from 1–180 seconds, preferably 1.5–120 seconds. A diffusible dye may be transferred onto an image-receiving layer simultaneously with thermal development by bringing the image-receiving layer in the image-receiving member into intimate contact with the light-sensitive surface of the photographic material. Alternatively, the photographic material brought into intimate contact with the image-receiving member after thermal development may be subsequently heated. The photographic material may be preliminarily heated in the temperature range of 70°–180 ° C. prior to exposure. In order to enhance the adhesion between the photographic material and the image-receiving member, they may be separately heated at a temperature of 80°–250° C. just prior to thermal development and transfer.

The heat-processible photographic material of the present invention permits the use of a variety of known heating techniques. All methods of heating that can be used with ordinary heat-processible photographic materials may be applied to the heat-processible photographic material of the present invention. In one instance, the photographic material may be brought into contact with a heated block or plate, or with heated rollers or a hot drum. Alternatively, the material may be passed through a hot atmosphere. High-frequency heating is also applicable. The heating pattern is in no way limited; preheating may be followed by another cycle of heating; heating may be performed for a short period at high temperatures or for a long period at low temperatures; the temperature may be elevated and lowered continuously; repeated cycles of heating may be employed; the heating may be discontinuous rather than continuous. A simple heating pattern is preferred. If desired, exposure and heating may proceed simultaneously.

Any image-receiving member may effectively be used in the present invention if the image-receiving layer employed has a capability for accepting the dye released or formed in the heat-processible light-sensitive layer as a result of thermal development. A preferred example is a polymer containing a tertiary amine or quaternary ammonium salt, as described in U.S. Pat. No. 3,709,690. Typical image-receiving layers suitable for use in diffusion transfer can be prepared by coating a base support, with a mixture in which a polymer containing an ammonium salt or tertiary amine is combined with gelatin or polyvinyl alcohol. Another useful dye-receiving layer may be formed of a heat-resistant organic high-molecular weight substance having a glass transition point of 40°–250° C. These polymers may be carried as image-receiving layers on a base support; alternatively, they may be used as bases on their own.

Synthetic polymers having glass transition points of 40° C. and above as described in "Polymer Handbook," 2nd ed., edited by J. Brandrup and E. H. Immergut, John Wiley & Sons are also useful. Useful molecular weights of these high-molecular weight substances are generally in the range of 2,000–200,000. These high-molecular weight substances may be used either independently or as blends. Two or more monomers may be employed to make copolymers. Particularly preferred image-receiving layers comprise polyvinyl chloride and polycarbonate, and a plasticizer.

The polymers described above may be used as base supports that also serve as image-receiving layers to form image-receiving members. In this case, the base support may be formed of a single layer or two or more layers.

Base supports for image-receiving members may be transparent or non-transparent. Illustrative supports include: films of polymers such as polyethylene terephthalate, polycarbonate, polystyrene, polyvinyl chloride, polyethylene and polypropylene; base supports having pigments such as titanium oxide, barium sulfate, calcium carbonate and talc incorporated in these plastic films; baryta paper; resin-coated (RC) paper having paper laminated with pigment-loaded thermoplastic resins; fabrics; glass; metals such as aluminum; base supports prepared by coating these materials with pigment-loaded electron beam curable resin compositions, followed by curing of the latter; and base supports having pigment-loaded coating layers on these materials.

Particularly useful are the base support prepared by coating paper with a pigment-loaded electron-beam curable resin composition, followed by curing of the resin, and the base support prepared by applying a pigment coating layer to paper, which is then coated with an electron-beam curable resin composition, followed by curing of the resin. These base supports can immediately be used as image-receiving members since the resin layer itself serves as an image-receiving layer.

The heat-processible photographic material of the present invention may be of the integral type in which the light-sensitive layer and the image-receiving layer are formed on the same base support.

The heat-processible photographic material of the present invention is preferably provided with a protective layer. The protective layer may contain a variety of additives that are commonly employed in the photographic industry. Suitable additives include matting agents, colloidal silica, slip agents, organofluoro compounds (in particular, fluorine-based surface active agents), antistats, uv absorbers, high-boiling organic solvents, anti-oxidants, hydroquinone derivatives, polymer lattices, surface-active agents (including high-molecular weight surface-active agents), hardeners (including high-molecular weight hardeners), particulate organic silver salts, non-light-sensitive silver halide grains, development accelerators, etc.

A preferred embodiment of the present invention comprises a multilayer heat-developable color-photographic material comprising a dye-diffusion-transfer element, activated by heat, said transfer element comprising contacting dye-receiver and dye-donor layers, where said receiver layers comprise a support, a polymeric layer comprising materials which have a high binding affinity for the yellow, magenta, and cyan dyes, and where said donor layers comprise a yellow dye producing layer, said layer comprising light-sensitive silver halide grains, an organic silver salt, a reducing agent, a yellow dye providing compound, and a hydrophilic binder, a magenta dye producing layer, said layer comprising light-sensitive silver halide grains, an organic silver salt, a reducing agent, a magenta dye providing compound, and a hydrophilic binder, a cyan dye producing layer, said layer comprising light-sensitive silver halide grains, an organic silver salt, a reducing agent, a cyan dye providing compound, and a hydrophilic binder, wherein said binder of said layers amount to from 3 to 10 g/m$^2$ of said coated material. These dyes are heat-transferable dyes. The dye-receiver and dye-donor layers may be coated together in a single, integral element. Alternatively, the dye-receiver and dye-donor layers may be coated in separate elements, said elements being laminated together prior to the thermal dye-diffusion transfer process. The preferred amount of thermal solvent according to formula I incorporated in a given layer is 0 to 300% by weight of the total amount of binder present in said layer. The amount of such thermal solvent incorporated in a given layer is 20 to 150% by weight of the total amount of binder present in said element.

The advantages of the present invention will become more apparent from the following examples. The following examples are meant to be illustrative of the invention and are not exhaustive in describing all the forms of the invention.

EXAMPLES

Example 1—Comparison

Thermal Solvent Melt Preparation. To a mixture of 31.50 g of thermal solvent TS-1 (n-octyl p-hydroxybenzoate), 30.10 g of a 10% solution of surfactant (Alkanol XC TM) and 16.8 g of ethyl acetate is added, with stirring, a warm solution of 201.6 g of melted and filtered 12.5% gelatin in 350 g of distilled water. This mixture is dispersed by three passes through a Gaulin Dispersion Mill set at a gap of 0.013 cm. To 480 g of this dispersion is added 12.0 g of 10% solution of surfactant (Active Olin 10G TM) 510 of distilled water and 38.4 g of melted and filtered 12.5% gelatin to prepare a coating melt.

TS-1

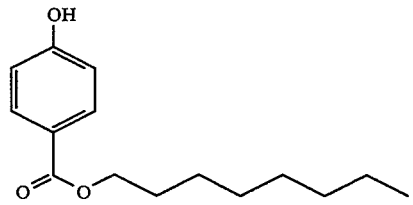

Dispersion Melt Preparation. To a warmed mixture of 1.152 g of coupler CM-1 and 3.50 g of ethyl acetate is added, with stirring, a warmed solution of 19.2 g of 12.5% gelatin in 33.7 g of distilled water and 2.40 g of an 10% solution of surfactant (Alkanol XCT TM). This mixture is dispersed by three passes thru a Gaulin Dispersion Mill with a gap of 0.013 cm. To 37.5 g of this dispersion is added 0.90 g of 10% solution of surfactant (Active Olin 10G TM), 54.4 g of distilled water and 7.2 g of 12.5% gelatin.

CM-1

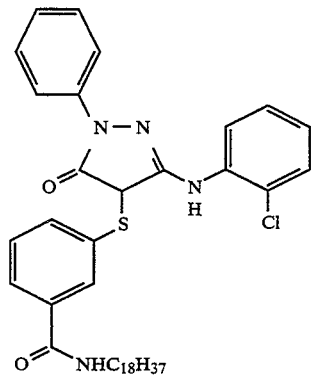

Emulsion Melt Preparation. To 84.2 g of an undoctored AgCl cubic emulsion spectrally sensitized with a green sensitizing dye SG-1 is added 53.3 g of 12.5% gelatin and 474 g of distilled water. The resulting melt has a silver content of 16.0 g of silver per kg of melt.

SG-1

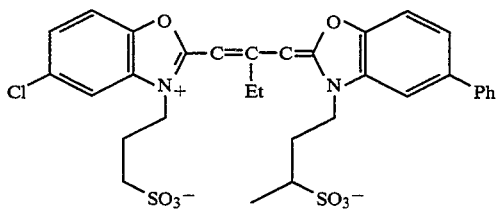

Protective Overcoat Melt Preparation. To 1840 g of distilled water is added 384 g of melted 12.5% gelatin and 36 g of a 10% solution of surfactant (Active Olin 10G TM). Within one minute of coating the protective overcoat 140 g of a 1.8% solution of the hardening agent, bis-(vinylsulfonyl) methane, is added.

Film Formation The thermal solvent dispersion is coated on the corona discharge treated polymeric receiver layer paper base at an aim laydown of 1.60 g $m^{-2}$ for both the gelatin and the thermal solvent TS-1. This paper base (Kodak Thermal Print Receiver NS Paper) consists essentially of a polycarbonate layer overcoated with a polycaprolactam layer on a titanium dioxide tinted paper. Over the first gelatin/thermal solvent layer is coated the silver halide emulsion and chromogenic image generating layer as follows. Thirty g of the emulsion melt described above is added to 100 g the coupler dispersion melt. The coating process, with an aim laydown of 1.60 g of gelatin $m^{-2}$, is initiated within 30 seconds and terminated within 3.0 minutes of melt mixing. After overcoating with the protective overcoat/hardener layer with an aim laydown of 1.08 g gelatin $m^{-2}$ and 1.35% hardener to total gelatin the coating is stored for 4 days prior to processing.

Photographic Processing. Several examples the coatings of example Set 1 are individually exposed on a Kodak 1-B sensitometer with a 0.01 sec 3000° K. white light exposure through an infrared filter and a 21 step 0 to 3.0 density step tablet. The coatings are developed for 45 sec at 35° C. in the developer formulation given below containing either Kodak Color Developer 3 (CD-3) or Kodak Color Developer 2 (CD-2), followed by a bleach-fix (45 sec, to remove the silver and silver halide for investigation purposes only) followed by a 90 sec wash in distilled water. The films are dried at low temperatures (less than 40° C). Status A reflection densitometry of the integral images prior to heat activated dye transfer are obtained. The for the 0.2 density toe speed (relative log of the exposure (LogE)) for this film is 0.82

| Color Developer Solutions | |
|---|---|
| Triethanolamine | 12.41 g |
| Phorwhite REU (Mobay) | 2.30 g |
| 30% aqueous Lithium polystyrene sulfonate | 0.30 g |
| 85% aqueous N,N-diethylhydroxylamine | 5.40 g |
| Lithium sulfate | 2.70 g |
| Kodak Color Developing Agent CD-3 or CD-2 | 0.01145 moles |
| 60% aqueous 1-Hydroxyethyl-1,1-diphosphonic acid | 1.16 g |
| Potassium Carbonate, anhydrous | 21.16 g |
| Potassium bicarbonate | 2.79 g |
| Potassium chloride | 1.60 g |
| Potassium bromide | 20 mg |
| Water to make one liter | — |
| pH 10.04 ± 0.05 at 27° C. | |

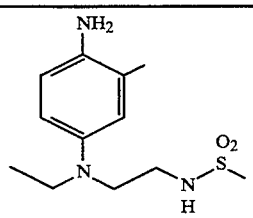

CD-3

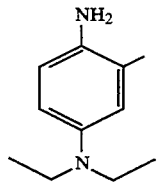

CD-2

| Bleach-Fix Solution | |
|---|---|
| Ammonium thiosulfate | 127.40 g |
| Sodium metabisulfite | 10.00 g |
| Glacial Acetic Acid | 10.20 g |
| Ammonium ferric EDTA | 110.40 g |
| Water to make one liter: | — |
| pH 5.50 ± 0.10 at 80° F. | |

Example 2—Comparison

A second film was prepared and tested in similar manner to example 1 except that the image coupler dispersion contained thermal solvent TS-1 prepared as follows.

Dispersion Melt Preparation. To a mixture of 3.84 g of thermal solvent TS-1, 2.40 parts of an 10% solution of surfactant (Alkanol XC TM), 1.152 g of coupler CM-1 and 3.50 g of ethyl acetate is added with stirring a warm solution of 19.2 g of 12.5% gelatin in 29.9 g of distilled water. This mixture is dispersed by three passes thru a Gaulin Dispersion Mill with a gap of 0.013 cm. To 37.5 g of this dispersion is added 0.90 g of a 10% solution of surfactant (Active Olin 10G TM), 54.4 g of distilled water and 7.2 g of melted and filtered 12.5% gelatin.

Film Formation Thirty grams of an emulsion melt described in example 1 above is added to 100 g the coupler dispersion containing the thermal solvent TS-1. The coating melt was held for 45 minutes at 40° C. prior to coating. This melt was coated over a thermal solvent test layer described above with an aim laydown of 1.60 mg of gelatin $m^{-2}$, 390 mg coupler 1 $m^{-2}$ and 1.30 g thermal solvent 1 $m^{-2}$. This film is overcoated as with example 1, stored and photographically processed as described for example 1. The relative photographic speed of this film example 2 is 2.55 at a density of 0.2 above fog is which is 1.73 logE less sensitive than that of example 1. This is an enormous loss in photographic activity that is due to the presence of the thermal solvent TS-1 in combination with the dye sensitized silver halide emulsion as further examples will show.

Example 3—Comparison

A film was prepared in a manner similar to film example 1 above except that the combined coating melt for the coupler dispersion/silver halide melt was held for 45 min. at 40° C. The 0.2 D photographic toe speed for this film example is 0.91. This example shows that for melt hold times of 45 min. there is a very small decrease in the photographic speed of a film in the absence of thermal solvent TS-1 in the coating melt.

Example 4—Invention

A film is prepared in a manner similar to film example 2 above in which the dispersion melt contains the thermal solvent TS-1 except that the combined coating melt for the image generating layer containing the silver halide emulsion, coupler CM-1 and thermal solvent TS-1 is coated about one minute after the combination of the two component melts and the coating is terminated after 3 minutes. The 0.2D photographic toe speed for this film example is 0.72. This photographic speed is comparable to that obtained with a melt that does not contain thermal solvent TS-1 (example 1 above). This example shows that in the presence of the thermal solvent TS-1 that total melt hold of less than 3 min will eliminate the enormous loss in photographic speed associated with the combination of thermal solvent TS-1 and dye sensitized emulsions of the type employed here.

Examples 5–9

A set of experiments similar to those described above were performed where the time between addition of the dye sensitized emulsion containing melt to the thermal solvent TS-1 and coupler CM-1 containing melt and the initiation and termination of the coating process was varied. The results of these coating variations on the photographic sensitometry are given in Table 1 with the essential conditions of the example preparations.

TABLE 1

Photographic Speed an a Function of Melt Hold Time

| Exp | Type | TS 1 mg ft$^{-2}$ | Melt Hold Time (min) | -Relative Log Exposure- +0.2 TOE | +1.0 MID |
|---|---|---|---|---|---|
| 5 | Inv | 150 | 2 | 0.85 | 1.23 |
| 6 | Comp. | 150 | 11 | 2.69 | • |
| 7 | Comp. | 150 | 21 | 2.64 | • |
| 8 | Comp. | 150 | 41 | 2.45 | 2.94 |
| 9 | Comp. | none | 2 | 0.70 | 1.05 |

These examples show that for coating melts containing both dye sensitized emulsions of the type employed here and as described in the prior art and thermal solvents of the type exemplified by thermal solvent TS-1 that are subjected to melt hold times of less than 2 min. substantially eliminate the enormous photographic sensitometry decreases observed for times of 11 minutes or more.

Examples 10–15

Two emulsions melts were prepared from a chemically sensitized but non halide-converted AgCl cubic emulsion spectrally sensitized with green sensitizing dye SG-1, identical except for the substitution (for water) of a KBr doctor solution to one of the emulsions. A melt, at 40° C. consisting of 41.38 g of silver chloride emulsion and 61.0 g gelatin per Ag mole, 26.28 g of melted and filtered 12.5% gelatin and 234 ml of distilled water was doctored by addition of 305 mg KBr/mole of Ag followed by stirring for 5 minutes. The two emulsions were each combined with a dispersion melt containing coupler CM-1 and thermal solvent TS-1 (n-octyl 4-hydroxybenzoate) These combined melts were coated in three pairs of matched melt-hold experiments of 0, 5 and 13 minutes relative duration on a 3.3 g m−2 thermal solvent test layer of 1:1 (wt:wt) gelatin and TS-1 which itself was coated over a polymeric receiver layer. These films were exposed and processed after 5 days of ambient keeping in a conventional rack and tank sink line process as described above with color developer 3 (CD-3) as the developing agent.

The densitometry of the processed films is summarized in Table 2. In comparison to the shortest coating time (ca. 1 min.) the undoctored emulsion gave a 0.2 D toe speed loss of more than 6 stops (1.9 logE) with the 13 minute additional melt-hold and a 2 stop speed loss with a 5 minute melt-hold. The KBr doctored dye sensitized silver chloride emulsion displays substantially smaller speed losses under both melt-hold conditions: relative to the shortest melt-hold for the 5 minute melt-hold experiment there is a loss of 0.2 stop (+0.06 logE) in 0.2 D toe speed while for the 13 minute melt-hold experiment the 0.2 D speed loss is slightly more than 2 stops (+0.60 logE). Similar variations in the 1.0 D speed are observed. Neither of the experiments performed with no additional melt holding condition showed significant variation from similar coatings of these emulsions in the absence of the phenolic material in the layer. The sensitometry of these films developed with CD-2 (as an equimolar replacment for CD-3) shows the same pattern as described above for CD3.

TABLE 2

Photographic Speed an a Function of Melt Hold Time

| Exp | Type | Doctor | Melt-Hold | Relative Log Exposure +0.2 O TOE | +1.0 D MID |
|---|---|---|---|---|---|
| 10 | Comp | − | 0 | 0.70 | 1.06 |
| 11 | Inv | + | 0 | 0.74 | 1.16 |
| 12 | Comp | − | 5 | 1.30 | 1.75 |
| 13 | Inv | + | 5 | 0.80 | 1.31 |
| 14 | Coup | − | 13 | 2.60 | • |
| 15 | Inv | + | 13 | 1.19 | 1.64 |

Examples 16 and 21

A set of coatings essentially similar to examples 10 through 15 above are prepared except that the emulsion is doctored with a solution of both KBr at 305 mg KBr/mole Ag and the anti-foggant, 1-(3-acetamidophenyl)-5-mercaptotetrazole, at 170 mg/mole Ag. Comparisons between doctored and undoctored emulsions that are subjected to matched pairs of melt hold conditions show similar behavior with respect to the effect of emulsion doctoring on melt-hold unsensitization as shown with examples 10 through 15 above.

Examples 22 and 23

Coating melts are prepared as in examples 1 and 2, that is, without and with, respectively, the presence of the thermal solvent TS-1 in the coupler dispersion. The image dye generating layer is coated by mixing the dye sensitized silver halide emulsion melt and the coupler containing melt just prior to the coating head in a ratio or 3 to 10, respectively. Completion of the coating examples, exposure, photographic processing and densitometry shows that the photographic sensitivity of these two films are the same and comparable to numerous other examples using similar emulsions, albeit generally without the incorporation of thermal solvents.

The invention has been described in detail with particular reference to preferred embodiments thereof, but it will be understood that variations and modifications can be effected with the spirit and scope of the invention.

What is claimed is:

1. A process for forming a chromogenic photographic heat-transferable non-aqueous dye-diffusion-transfer photographic element comprising the steps of:

providing, separately, a melt comprising a spectrally dye-sensitized silver halide emulsion, and a dry diffusion transfer facilitating thermal solvent;

mixing said spectrally dye-sensitized silver halide emulsion melt and said dry diffusion transfer facilitating thermal solvent with a mixing means to create a mixed melt, wherein said mixing means comprises a means for pumping separate flows of liquefied photographic emulsion containing melt and the thermal solvent at a predetermined rate to a common junction at which the flows intermix into a common flow upon coming into contact;

providing a coating substrate;

coating said mixed melt on said substrate to form a coated photographic element, wherein said coating takes place less than about 10 minutes after mixing.

2. The process of claim 1, wherein a dye-receiving layer is further coated on said substrate.

3. The process of claim 1, wherein the emulsion melt and the thermal solvent are liquefied before mixing.

4. The process of claim 1, wherein said dry diffusion transfer facilitating thermal solvent is in a melt comprising a dye-providing compound prior to said mixing.

5. The process of claim 1, wherein said silver halide emulsion is a halide converted silver chloride emulsion.

6. The process of claim 1, wherein said mixing means comprises a static in-line mixing means.

7. The process of claim 1, wherein said mixing means comprises an active in-line mixing means.

8. The process of claim 1, wherein said coating takes place within 120 seconds of mixing.

9. The process of claim 1, wherein said thermal solvent comprises 10 to 120 percent by weight of the total hydrophilic binder in said photographic element.

10. The process of claim 1, wherein said chromogenic photographic heat-transferable non-aqueous dye-diffusion-transfer photographic element is aqueously developable.

11. The process of claim 1, wherein said chromogenic photographic heat-transferable non-aqueous dye-diffusion-transfer photographic element is heat developable.

12. The process of claim 1, wherein said thermal solvent has the formula (I)

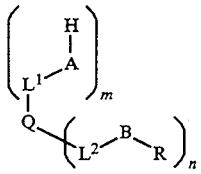

(I)

wherein

AH is a hydrogen bond donating group with an aqueous $pK_a$ value for proton loss of greater than 6;

$L^1$ and $L^2$ are each independently divalent linking groups consisting of groups of 1 to 12 atoms or are independently absent;

m is 1, 2, or 3;

Q comprises a group of 2 to 15 carbon atoms selected from the group consisting of aromatic rings, alkyl chains, alkyl rings, or ring-chain combinations, optionally substituted with substituents, Z, consisting of alkyl groups or halogens;

B is a hydrogen bond accepting group with an aqueous $pK_a$ value for proton gain of less than 6;

n is 1 or 2;

at least one of the groups AH and B cannot hydrogen bond to form a ring of either 5 or 6 atoms;

R is an alkyl, aryl or alkylaryl group of 1 to 18 carbon atoms;

the calculated log of the octanol/water partition coefficient (clogP) is greater than 3 and less than 10.

13. The process of claim 1, wherein said mixed melt comprises a dye forming compound.

14. The process of claim 1, wherein said mixed melt comprises a dye forming compound having a dye forming fragment having a formula weight of at least 90 and less than 600.

15. The process of claim 1, wherein said thermal solvent has the formula (II)

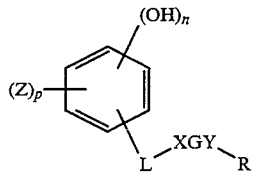

(II)

wherein n is 1, 2 or 3;

p is 0 to 5−n;

Z is a substituent, where each Z consists independently of groups selected from alkyl groups of 1 to 8 carbon atoms or halogens;

L is an alkyl or alkoxy group of from 1 to 6 carbon atoms or is absent;

XGY is a hydrogen bond accepting group where X and Y are each independently absent, O, or $NR^b$, where $R^b$ is hydrogen or a primary alkyl, primary alkylaryl, or aryl group of from 1 to 8 carbons, and where G is a carbonyl group;

R is an alkyl group of 1 to 18 carbon atoms;

at least one OH group and any hydrogen bond accepting atom in XGY cannot hydrogen bond to form a ring of either 5 or 6 atoms, the calculated log of the octanol/water partition coefficient (clogP) is greater than 3 and less than 10.

16. The process of claim 1, wherein said thermal solvent comprises a sugar group containing amphiphilic compound, said amphiphilic compound comprising from one to three independently constituted 3 to 22 carbon atom hydrophilic tail(s) with one or more attached hydrophilic mono or oligosaccaridic rings or chains such that the HLB value of the compound is less than about 13.

17. The process of claim 1, wherein said chromogenic photographic heat-transferable non-aqueous dye-diffusion-transfer photographic element is a multilayer aqueous-developable color-photographic heat-transferable non-aqueous dye-diffusion-transfer photographic element further comprising a support;

a heat-transferable yellow dye producing layer containing a heat-transferable yellow dye providing compound, a radiation sensitive silver halide, and a hydrophilic binder;

a heat-transferable magenta dye producing layer containing a heat-transferable magenta dye providing compound, a radiation sensitive silver halide, and a hydrophilic binder; and a heat-transferable cyan dye producing layer containing a heat-transferable cyan dye providing compound, a radiation sensitive silver halide, and a hydrophilic binder.

18. The process of claim 1, wherein said thermal solvent has the formula (III)

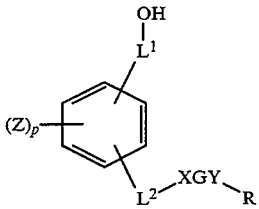

(III)

wherein $L^1$ is an alkoxy group of 2 to 6 carbons, a 1,4-dioxyhexyl group, or an alkyl group of 1 to 6 carbons, or is absent;

p is 0 to 4

Z is a substituent, where each Z consists independently of groups selected from alkyl groups of 1 to 8 carbon atoms or halogens;

$L^2$ is an alkyl or alkoxy group of from 1 to 6 carbon atoms or is absent;

XGY is a hydrogen bond accepting group where X and Y are each independently absent, O, or $NR^b$, where $R^b$ is hydrogen or a primary alkyl, primary alkylaryl, or aryl group of from 1 to 8 carbons, and where G is a carbonyl group;

R is an alkyl group of 1 to 18 carbon atoms;

the OH group and any hydrogen bond accepting atom in XGY cannot hydrogen bond to form a ring of either 5 or 6 atoms, the calculated log of the octanol/water partition coefficient (clogP) is greater than 3 and less than 10.

19. The process of claim 1, wherein said thermal solvent has the formula (IV)

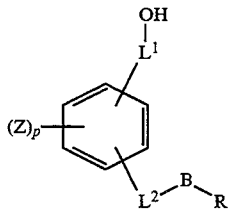

(IV)

wherein $L^1$ is an alkoxy group of 2 to 6 carbons, a 1,4-dioxyhexyl group, or an alkyl group of 1 to 6 carbons, or is absent;

p is 0 to 4,

Z is a substituent, where each Z consists independently of groups selected from alkyl groups of 1 to 8 carbon atoms or halogens;

$L^2$ is an alkyl or alkoxy group of from 1 to 6 carbon atoms or is absent;

B is a hydrogen bond accepting group selected from the group of oxygen, sulfur or XGY, where X and Y are each independently absent, O, or $NR^b$, where $R^b$ is hydrogen or a primary alkyl, primary alkylaryl, or aryl group of from 1 to 8 carbons, and where G is a sulfonyl group;

R is an alkyl group of 1 to 18 carbon atoms;

the OH group and any hydrogen bond accepting atom in XGY cannot hydrogen bond to form a ring of either 5 or 6 atoms;

the calculated log of the octanol/water partition coefficient (clogP) is greater than 3 and less than 10.

20. A process for forming a chromogenic photographic heat-transferable non-aqueous dye-diffusion-transfer photographic element comprising the steps of:

providing, separately, a melt comprising a spectrally dye-sensitized silver halide emulsion, and a dry diffusion transfer facilitating thermal solvent; wherein said dye sensitized emulsion and said thermal solvent are mixed as solid gelled melts:

mixing said spectrally dye-sensitized silver halide emulsion melt and said dry diffusion transfer facilitating thermal solvent with a mixing means to create a mixed melt;

providing a coating substrate;

coating said mixed melt on said substrate to form a coated photographic element, wherein said coating takes place less than about 10 minutes after mixing.

21. The process of claim 20, wherein a dye-receiving layer is further coated on said substrate.

22. The process of claim 20, wherein said silver halide emulsion is a halide converted silver chloride emulsion.

23. The process of claim 20, wherein said mixing means comprises a static in-line mixing means.

24. The process of claim 20, wherein said mixing means comprises an active in-line mixing means.

25. The process of claim 20, wherein said chromogenic photographic heat-transferable non-aqueous dye-diffusion-transfer photographic element is aqueously developable.

26. The process of claim 20, wherein said chromogenic photographic heat-transferable non-aqueous dye-diffusion-transfer photographic element is heat developable.

27. The process of claim 20, wherein said thermal solvent has the formula (I)

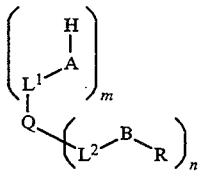

(I)

wherein

AH is a hydrogen bond donating group with an aqueous $pK_a$ value for proton loss of greater than 6;

$L^1$ and $L^2$ are each independently divalent linking groups consisting of groups of 1 to 12 atoms or are independently absent;

m is 1, 2, or 3;

Q comprises a group of 2 to 15 carbon atoms selected from the group consisting of aromatic rings, alkyl chains, alkyl rings, or ring-chain combinations, optionally substituted with substituents, Z, consisting of alkyl groups or halogens;

B is a hydrogen bond accepting group with an aqueous $pK_a$ value for proton gain of less than 6;

n is 1 or 2;

at least one of the groups AH and B cannot hydrogen bond to form a ring of either 5 or 6 atoms;

R is an alkyl, aryl or alkylaryl group of 1 to 18 carbon atoms;

the calculated log of the octanol/water partition coefficient (clogP) is greater than 3 and less than 10.

28. The process of claim 20, wherein said thermal solvent has the formula (II)

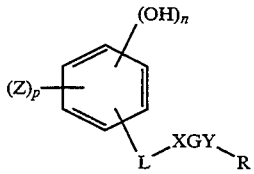

(II)

wherein n is 1, 2 or 3;

p is 0 to 5−n;

Z is a substituent, where each Z consists independently of groups selected from alkyl groups of 1 to 8 carbon atoms or halogens;

L is an alkyl or alkoxy group of from 1 to 6 carbon atoms or is absent;

XGY is a hydrogen bond accepting group where X and Y are each independently absent, O, or $NR^b$, where $R^b$ is hydrogen or a primary alkyl, primary alkylaryl, or aryl group of from 1 to 8 carbons, and where G is a carbonyl group;

R is an alkyl group of 1 to 18 carbon atoms;

at least one OH group and any hydrogen bond accepting atom in XGY cannot hydrogen bond to form a ring of either 5 or 6 atoms;

the calculated log of the octanol/water partition coefficient (clogP) is greater than 3 and less than 10.

29. The process of claim 20, wherein said thermal solvent has the formula (III)

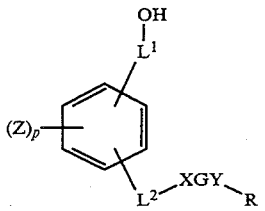

(III)

wherein $L^1$ is an alkoxy group of 2 to 6 carbons, a 1,4-dioxyhexyl group, or an alkyl group of 1 to 6 carbons, or is absent;

p is 0 to 4

Z is a substituent, where each Z consists independently of groups selected from alkyl groups of 1 to 8 carbon atoms or halogens;

$L^2$ is an alkyl or alkoxy group of from 1 to 6 carbon atoms or is absent;

XGY is a hydrogen bond accepting group where X and Y are each independently absent, O, or $NR^b$, where $R^b$ is hydrogen or a primary alkyl, primary alkylaryl, or aryl group of from 1 to 8 carbons, and where G is a carbonyl group;

R is an alkyl group of 1 to 18 carbon atoms;

the OH group and any hydrogen bond accepting atom in XGY cannot hydrogen bond to form a ring of either 5 or 6 atoms;

the calculated log of the octanol/water partition coefficient (clogP) is greater than 3 and less than 10.

30. The process of claim 20, wherein said thermal solvent has the formula (IV)

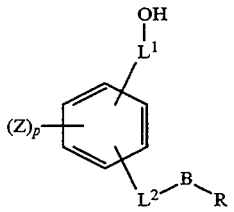

(IV)

wherein $L^1$ is an alkoxy group of 2 to 6 carbons, a 1,4-dioxyhexyl group, or an alkyl group of 1 to 6 carbons, or is absent;

p is 0 to 4

Z is a substituent, where each Z consists independently of groups selected from alkyl groups of 1 to 8 carbon atoms or halogens;

$L^2$ is an alkyl or alkoxy group of from 1 to 6 carbon atoms or is absent;

B is a hydrogen bond accepting group selected from the group of oxygen, sulfur or XGY, where X and Y are each independently absent, O, or $NR^b$, where $R^b$ is hydrogen or a primary alkyl, primary alkylaryl, or aryl group of from 1 to 8 carbons, and where G is a sulfonyl group;

R is an alkyl group of 1 to 18 carbon atoms;

the OH group and any hydrogen bond accepting atom in XGY cannot hydrogen bond to form a ring of either 5 or 6 atoms;

the calculated log of the octanol/water partition coefficient (clogP) is greater than 3 and less than 10.

31. The process of claim 20, wherein said thermal solvent comprises a sugar group containing amphiphilic compound, said amphiphilic compound comprising from one to three independently constituted 3 to 22 carbon atom hydrophilic tail(s) with one or more attached hydrophilic mono or oligosaccaridic rings or chains such that the HLB value of the compound is less than about 13.

32. The process of claim 20, wherein said chromogenic photographic heat-transferable non-aqueous dye-diffusion-transfer photographic element is a multilayer aqueous-developable color-photographic heat-transferable non-aqueous dye-diffusion-transfer photographic element further comprising a support;

a heat-transferable yellow dye producing layer containing a heat-transferable yellow dye providing compound, a radiation sensitive silver halide, and a hydrophilic binder;

a heat-transferable magenta dye producing layer containing a heat-transferable magenta dye providing compound, a radiation sensitive silver halide, and a hydrophilic binder; and a heat-transferable cyan dye producing layer containing a heat-transferable cyan dye providing compound, a radiation sensitive silver halide, and a hydrophilic binder.

33. A process for forming a chromogenic photographic heat-transferable non-aqueous dye-diffusion-transfer photographic element comprising the steps of:

providing, separately, a melt comprising a spectrally dye-sensitized silver halide emulsion, and a dry diffusion transfer facilitating thermal solvent;

mixing said spectrally dye-sensitized silver halide emulsion melt and said dry diffusion transfer facilitating thermal solvent with a mixing means to create a mixed melt;

providing a coating substrate;

coating said mixed melt on said substrate to form a coated photographic element, wherein said coating takes place less than about 10 minutes after mixing;

wherein said thermal solvent has the formula (I)

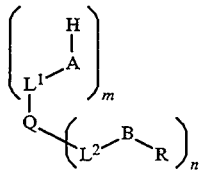

(I)

wherein

AH is a hydrogen bond donating group with an aqueous $pK_a$ value for proton loss of greater than 6;

$L^1$ and $L^2$ are each independently divalent linking groups consisting of groups of 1 to 12 atoms or are independently absent;

m is 1, 2, or 3;

Q comprises a group of 2 to 15 carbon atoms selected from the group consisting of aromatic rings, alkyl chains, alkyl rings, or ring-chain combinations, optionally substituted with substituents, Z, consisting of alkyl groups or halogens;

B is a hydrogen bond accepting group with an aqueous $pK_a$ value for proton gain of less than 6;

n is 1 or 2;

at least one of the groups AH and B cannot hydrogen bond to form a ring of either 5 or 6 atoms;

R is an alkyl, aryl or alkylaryl group of 1 to 18 carbon atoms;

the calculated log of the octanol/water partition coefficient (clogP) is greater than 3 and less than 10.

34. The process of claim 33, wherein a dye-receiving layer is further coated on said substrate.

35. The process of claim 33, wherein said silver halide emulsion is a halide converted silver chloride emulsion.

36. The process of claim 33, wherein said mixing means comprises a static in-line mixing means.

37. The process of claim 33, wherein said mixing means comprises an active in-line mixing means.

38. The process of claim 33, wherein said chromogenic photographic heat-transferable non-aqueous dye-diffusion-transfer photographic element is aqueously developable.

39. The process of claim 33, wherein said chromogenic photographic heat-transferable non-aqueous dye-diffusion-transfer photographic element is heat developable.

40. The process of claim 33, wherein said thermal solvent has the formula (II)

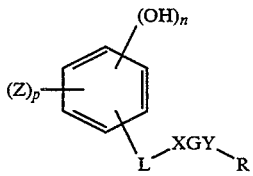

(II)

wherein n is 1, 2 or 3;

p is 0 to 5−n;

Z is a substituent, where each Z consists independently of groups selected from alkyl groups of 1 to 8 carbon atoms or halogens;

L is an alkyl or alkoxy group of from 1 to 6 carbon atoms or is absent;

XGY is a hydrogen bond accepting group where X and Y are each independently absent, O, or $NR^b$, where $R^b$ is hydrogen or a primary alkyl, primary alkylaryl, or aryl group of from 1 to 8 carbons, and where G is a carbonyl group;

R is an alkyl group of 1 to 18 carbon atoms;

at least one OH group and any hydrogen bond accepting atom in XGY cannot hydrogen bond to form a ring of either 5 or 6 atoms;

the calculated log of the octanol/water partition coefficient (clogP) is greater than 3 and less than 10.

41. The process of claim 33, wherein said thermal solvent has the formula (III)

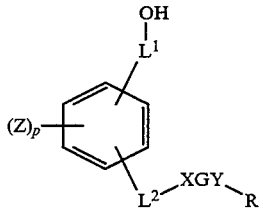

(III)

wherein $L^1$ is an alkoxy group of 2 to 6 carbons, a 1,4-dioxyhexyl group, or an alkyl group of 1 to 6 carbons, or is absent;

p is 0 to 4

Z is a substituent, where each Z consists independently of groups selected from alkyl groups of 1 to 8 carbon atoms or halogens;

$L^2$ is an alkyl or alkoxy group of from 1 to 6 carbon atoms or is absent;

XGY is a hydrogen bond accepting group where X and Y are each independently absent, O, or $NR^b$, where $R^b$ is hydrogen or a primary alkyl, primary alkylaryl, or aryl group of from 1 to 8 carbons, and where G is a carbonyl group;

R is an alkyl group of 1 to 18 carbon atoms;

the OH group and any hydrogen bond accepting atom in XGY cannot hydrogen bond to form a ring of either 5 or 6 atoms;

the calculated log of the octanol/water partition coefficient (clogP) is greater than 3 and less than 10.

42. The process of claim 33, wherein said thermal solvent has the formula (IV)

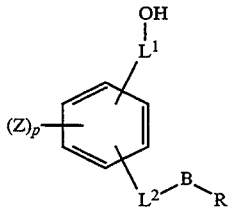

(IV)

wherein $L^1$ is an alkoxy group of 2 to 6 carbons, a 1,4dioxyhexyl group, or an alkyl group of 1 to 6 carbons, or is absent;

p is 0 to 4

Z is a substituent, where each Z consists independently of groups selected from alkyl groups of 1 to 8 carbon atoms or halogens;

$L^2$ is an alkyl or alkoxy group of from 1 to 6 carbon atoms or is absent;

B is a hydrogen bond accepting group selected from the group of oxygen, sulfur or XGY, where X and Y are each independently absent, O, or $NR^b$, where $R^b$ is hydrogen or a primary alkyl, primary alkylaryl, or aryl group of from 1 to 8 carbons, and where G is a sulfonyl group;

R is an alkyl group of 1 to 18 carbon atoms;

the OH group and any hydrogen bond accepting atom in XGY cannot hydrogen bond to form a ring of either 5 or 6 atoms;

the calculated log of the octanol/water partition coefficient (clogP) is greater than 3 and less than 10.

43. The process of claim 33, wherein said thermal solvent comprises a sugar group containing amphiphilic compound, said amphiphilic compound comprising from one to three independently constituted 3 to 22 carbon atom hydrophilic tail(s) with one or more attached hydrophilic mono or oligosaccaridic rings or chains such that the HLB value of the compound is less than about 13.

44. The process of claim 33, wherein said chromogenic photographic heat-transferable non-aqueous dye-diffusion-transfer photographic element is a multilayer aqueous-developable color-photographic heat-transferable non-aqueous dye-diffusion-transfer photographic element further comprising a support;

a heat-transferable yellow dye producing layer containing a heat-transferable yellow dye providing compound, a radiation sensitive silver halide, and a hydrophilic binder;

a heat-transferable magenta dye producing layer containing a heat-transferable magenta dye providing compound, a radiation sensitive silver halide, and a hydrophilic binder; and a heat-transferable cyan dye producing layer containing a heat-transferable cyan dye providing compound, a radiation sensitive silver halide, and a hydrophilic binder.

* * * * *